US010982341B2

(12) United States Patent
Hirano et al.

(10) Patent No.: US 10,982,341 B2
(45) Date of Patent: Apr. 20, 2021

(54) CATION EXCHANGE MEMBRANE AND ELECTROLYZER

(71) Applicant: ASAHI KASEI KABUSHIKI KAISHA, Tokyo (JP)

(72) Inventors: Toshinori Hirano, Tokyo (JP); Takuya Morikawa, Tokyo (JP); Yoshifumi Kado, Tokyo (JP); Takuo Sawada, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 58 days.

(21) Appl. No.: 15/724,518

(22) Filed: Oct. 4, 2017

(65) Prior Publication Data

US 2018/0142367 A1 May 24, 2018

(30) Foreign Application Priority Data

Oct. 6, 2016 (JP) ..... 2016-198403

(51) Int. Cl.

| | |
|---|---|
| ***C25B 13/02*** | (2006.01) |
| ***C25B 9/08*** | (2006.01) |
| ***C25B 9/18*** | (2006.01) |
| ***C25B 1/46*** | (2006.01) |

(52) U.S. Cl.

CPC ..... *C25B 13/02* (2013.01); *C25B 1/46* (2013.01); *C25B 9/08* (2013.01); *C25B 9/18* (2013.01)

(58) Field of Classification Search

None

See application file for complete search history.

(56) References Cited

U.S. PATENT DOCUMENTS 4,437,951 A * 3/1984 Bissot ..... C25B 1/46 205/521
4,552,631 A * 11/1985 Bissot ..... C25B 1/46 205/521

(Continued)

FOREIGN PATENT DOCUMENTS

JP 3-158486 A 7/1991
JP 6-128782 5/1994

(Continued)

OTHER PUBLICATIONS

"How to Estimate the Diameter of Yarn and Thread", published by Service Thread, availalble at https://www.servicethread.com/blog/how-to-estimate-yarn-diameter-and-denier-size, accessed on May 7, 2019 (Year: 2019).*

(Continued)

*Primary Examiner* — Harry D Wilkins, III

(74) *Attorney, Agent, or Firm* — Greenblum & Bernstein, P.L.C.

(57) ABSTRACT

[Problem to be Solved]

A cation exchange membrane that has sufficient mechanical strength and at the same time has high impurity resistance, suffers little cathode surface damage, and exhibits stable electrolytic characteristics is provided.

[Solution]

A cation exchange membrane comprising:

a membrane body comprising a fluorine-containing polymer having an ion exchange group; and a reinforcement core material arranged inside the membrane body, wherein raised portions having a height of 20 μm or more in cross-sectional view are formed on at least one surface of the membrane body, an arrangement density of the raised portions on the surface of the membrane body is 20 to 1500/cm$^2$, (Continued)

a plurality of opening portions are formed on the surface of the membrane body, and a proportion of a total area of the opening portions to an area of the surface of the membrane body (opening area ratio) is in a range of 0.4 to 15%.

8 Claims, 12 Drawing Sheets

(56) References Cited

U.S. PATENT DOCUMENTS 4,872,958 A * 10/1989 Suzuki ..... C08J 5/2275 205/521
5,252,193 A 10/1993 Powers
6,756,328 B2 * 6/2004 Sakuma ..... D03D 15/00 264/41
2009/0120788 A1 5/2009 Kashiwada et al.

FOREIGN PATENT DOCUMENTS

JP 4573715 11/2010
JP 4708133 6/2011
JP 2013-163857 A 8/2013

OTHER PUBLICATIONS

"Rayon Fiber", published by Conservation and Art Materials Encyclopedia Online, available at http://cameo.mfa.org/wiki/Rayon_fiber, accessed on May 7, 2019 (Year: 2019).*

* cited by examiner

[Figure 1]
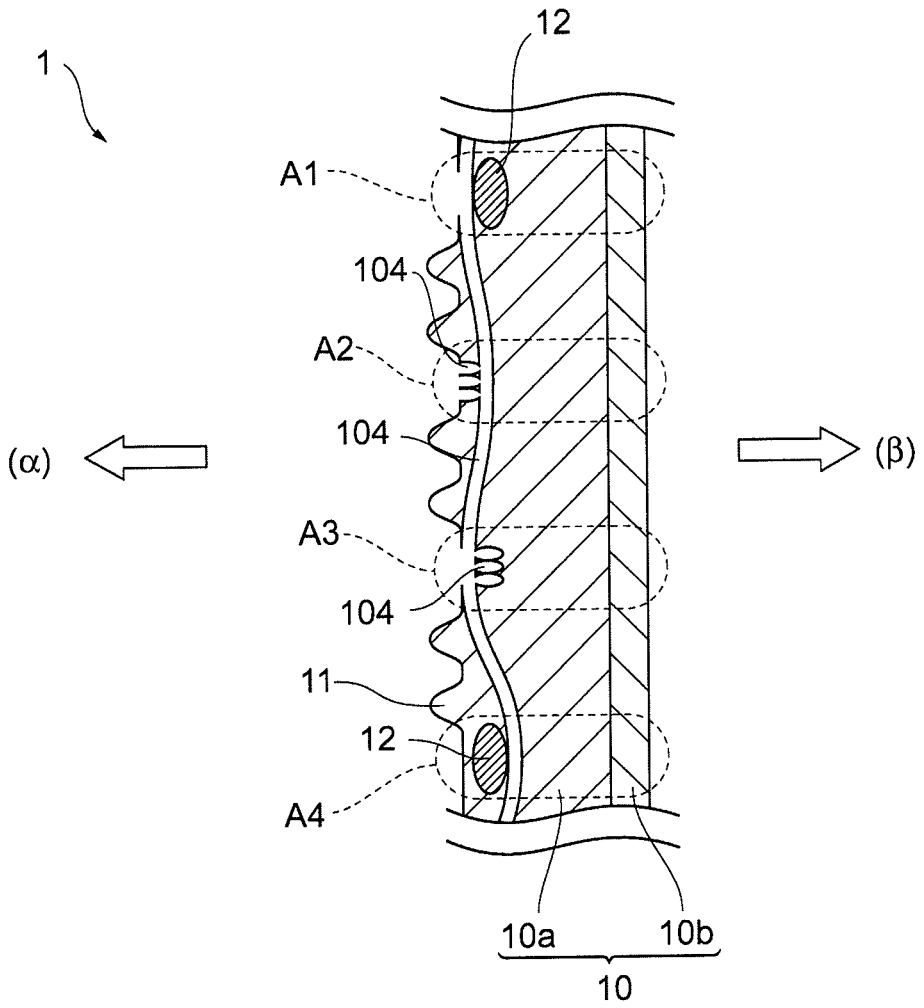

[Figure 2]
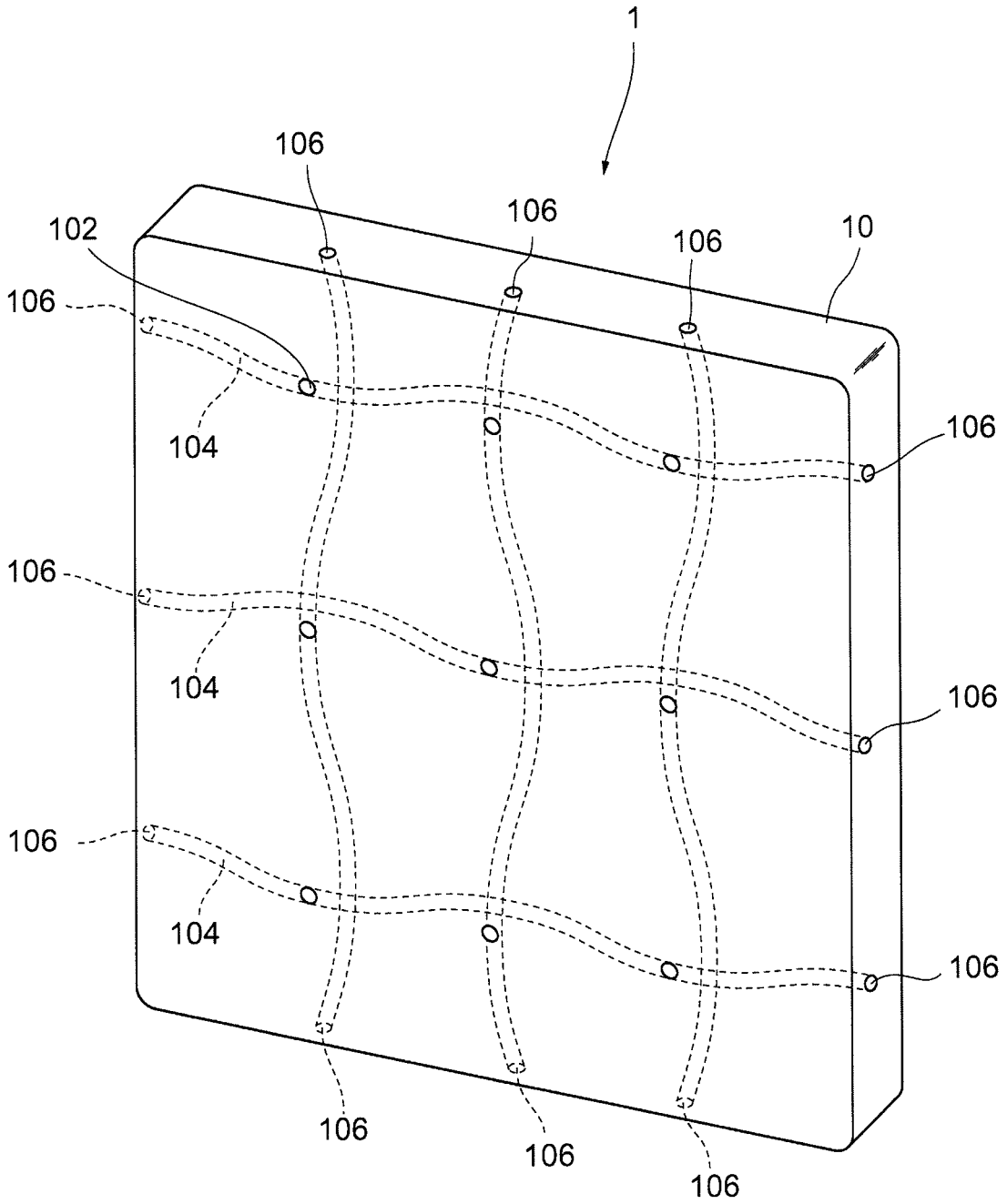

[Figure 3]
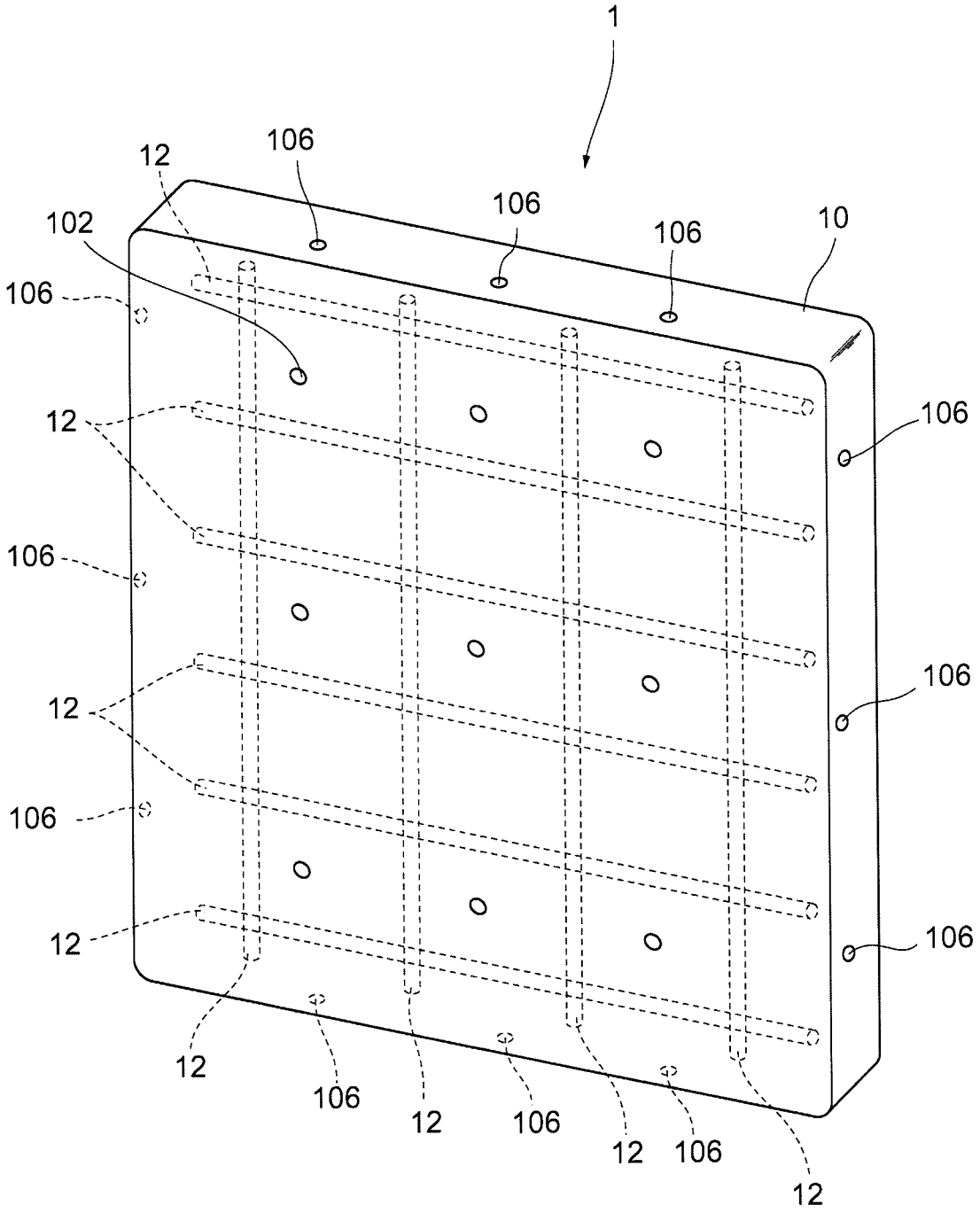

[Figure 4]
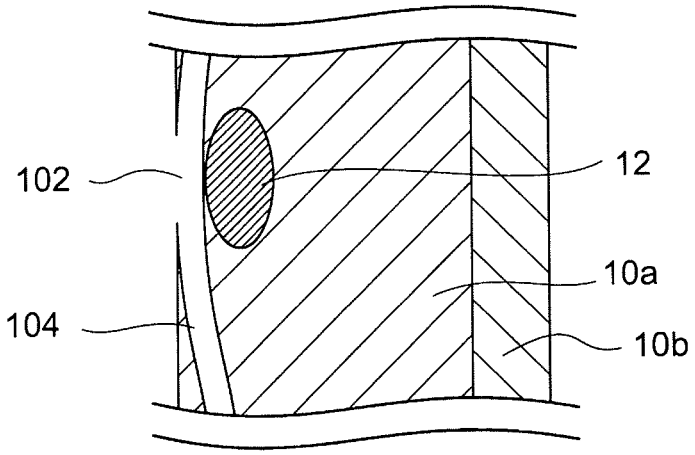
[Figure 5]
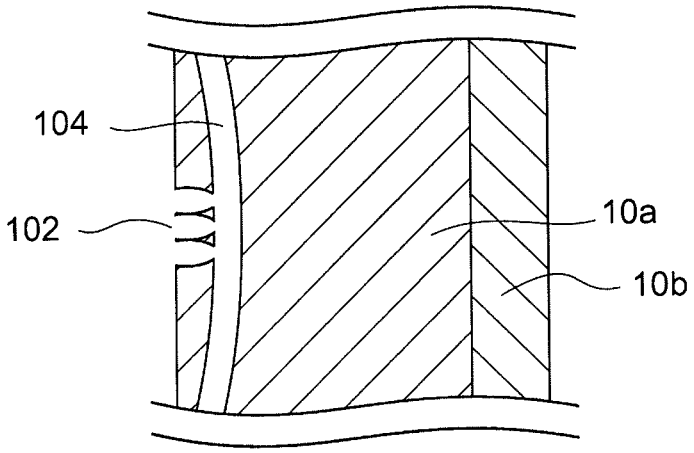

[Figure 6]
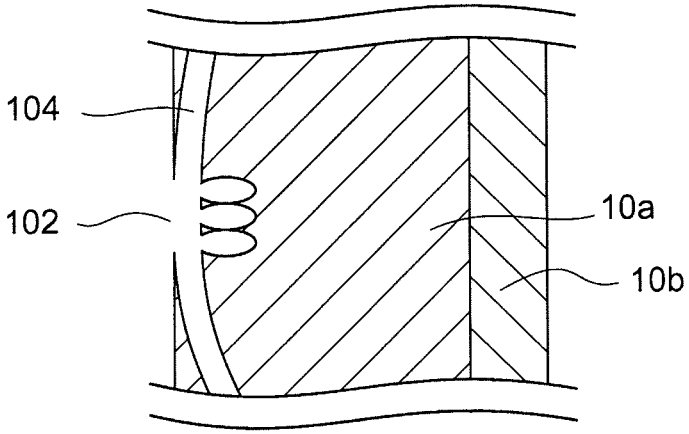

[Figure 7]
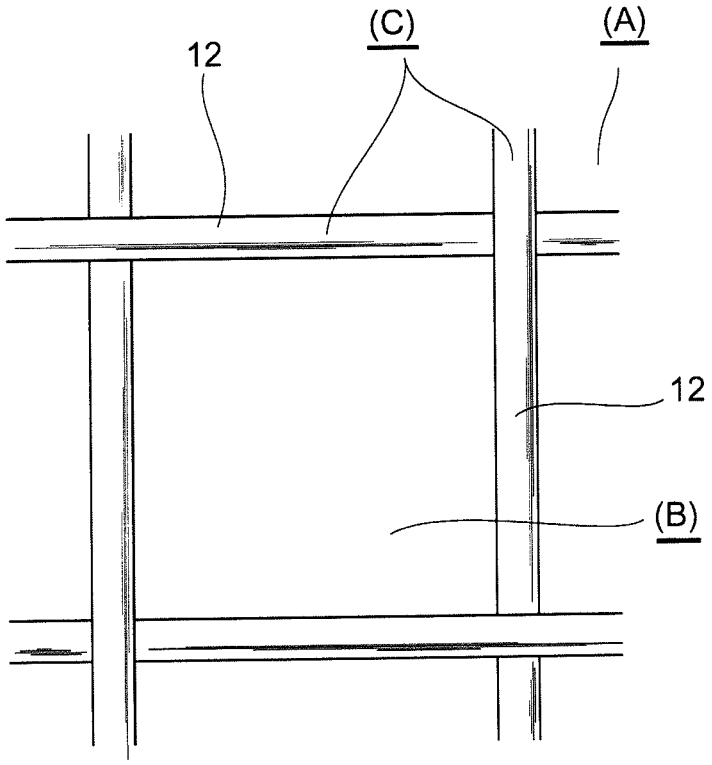
(B)=(A)-(C)
(B)/(A)=((A)-(C))/(A)

[Figure 8]
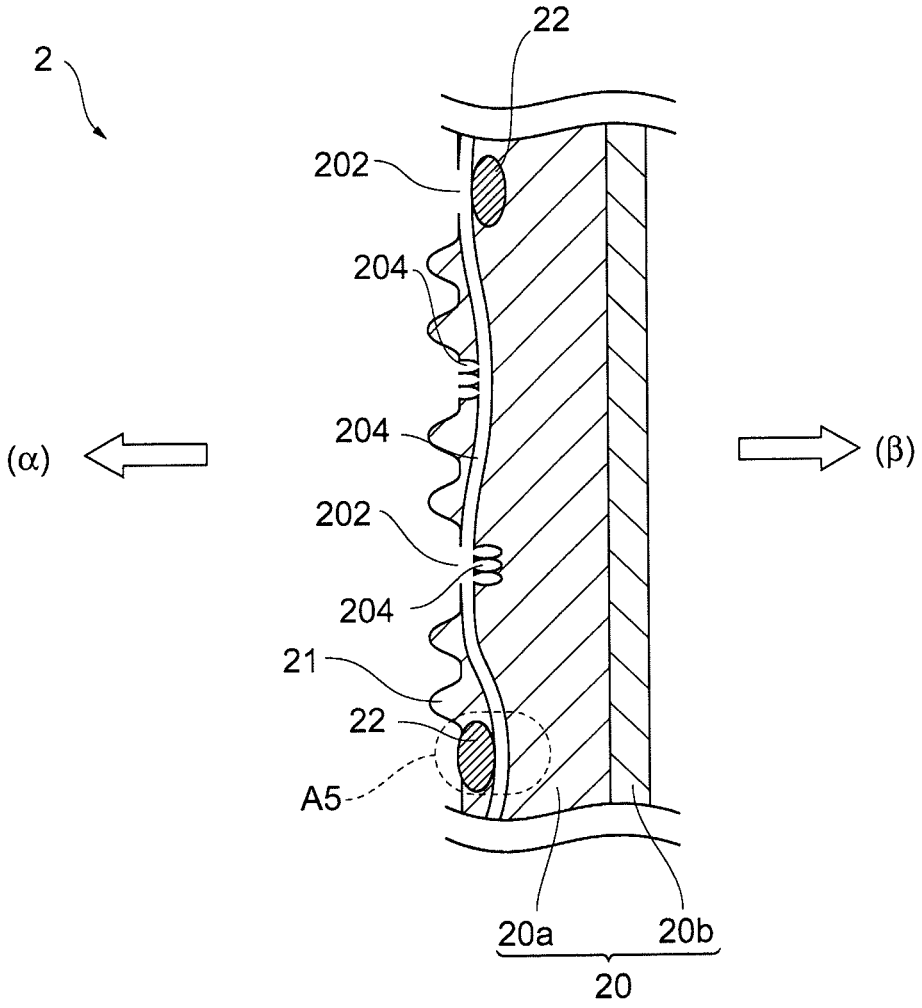

[Figure 9]
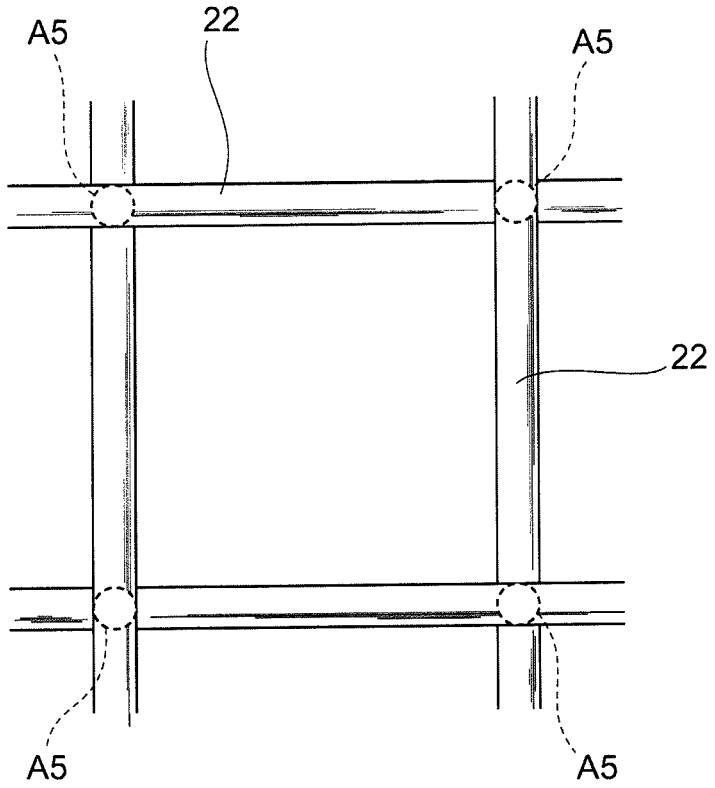

[Figure 10]
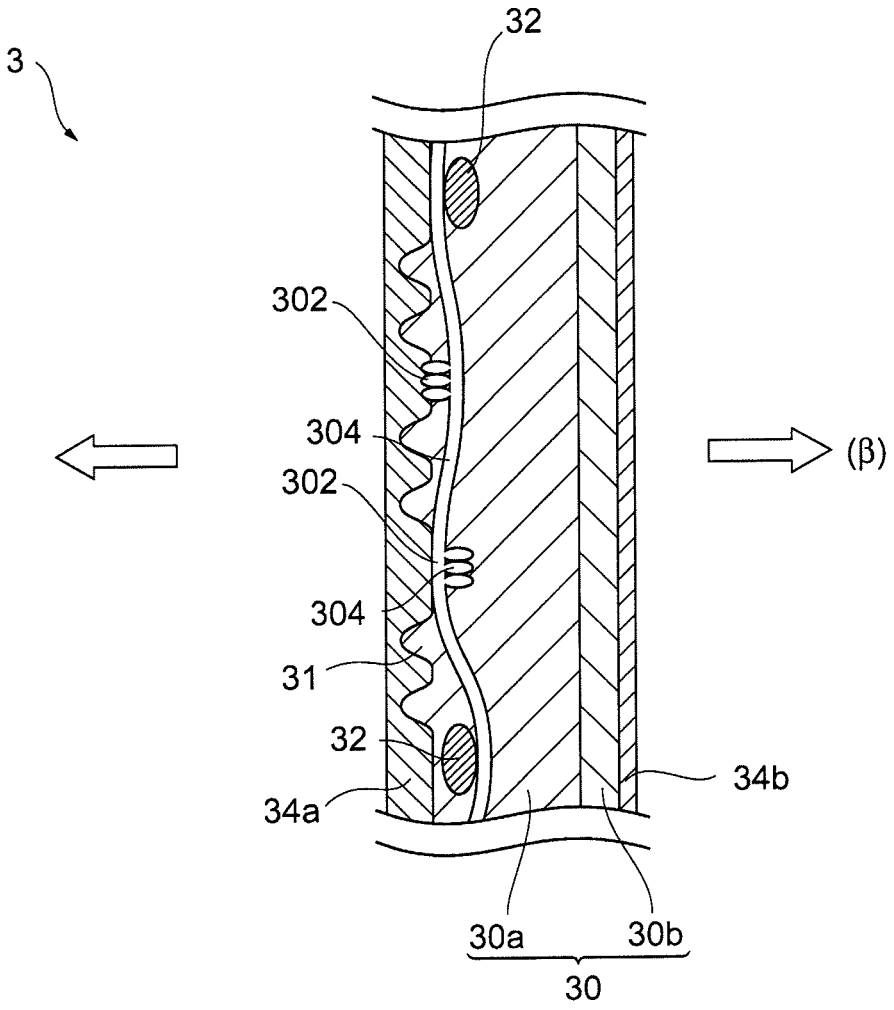

[Figure 11]
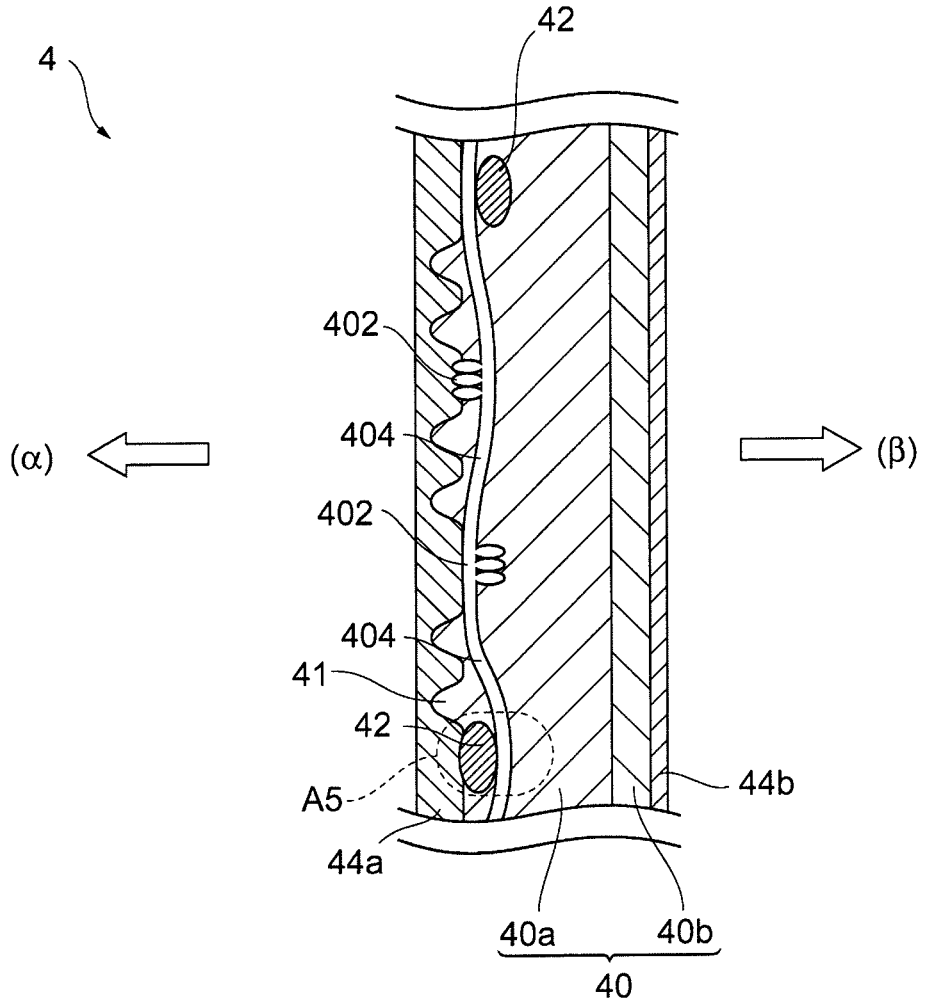

[Figure 12]
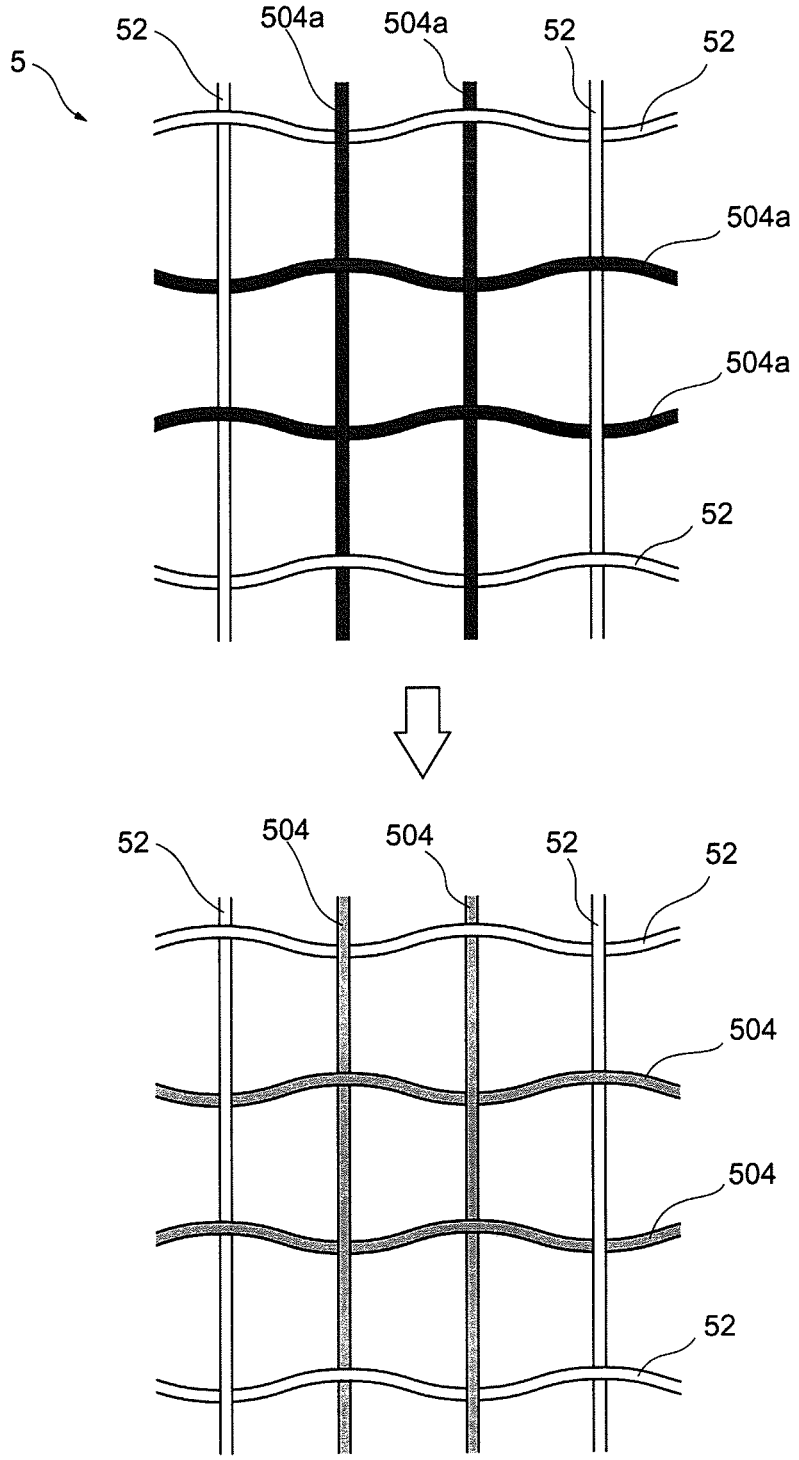

[Figure 13]
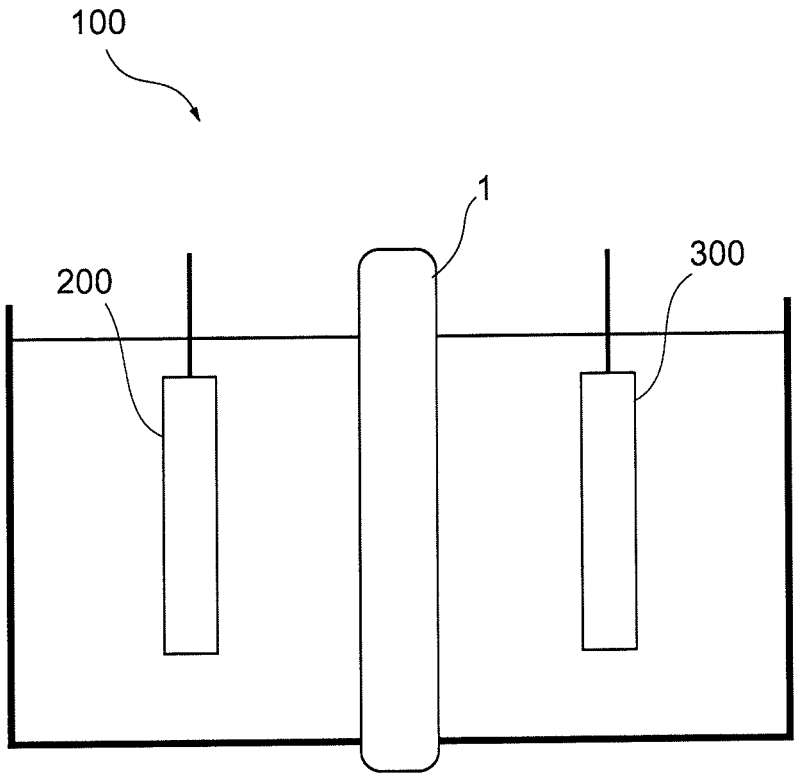

CATION EXCHANGE MEMBRANE AND ELECTROLYZER

TECHNICAL FIELD

The present invention relates to a cation exchange membrane and an electrolyzer using the same.

BACKGROUND ART

Fluorine-containing cation exchange membranes have excellent heat resistance, chemical resistance, and the like and therefore are used as electrolytic cation exchange membranes for producing chlorine and alkalis by electrolysis of alkali chlorides and the like. In addition, fluorine-containing cation exchange membranes are used as ozone generation diaphragms, various electrolytic diaphragms for fuel cells, water electrolysis, and hydrochloric acid electrolysis, and the like. Among them, in electrolysis of an alkali chloride in which brine or the like is electrolyzed to produce caustic soda, chlorine, and hydrogen, a cation exchange membrane composed of at least two layers, a carboxylic acid layer having a carboxylic acid group as an ion exchange group and having high anion exclusion properties and a low resistance sulfonic acid layer having a sulfonic acid group as an ion exchange group, is generally used. This cation exchange membrane is in direct contact with chlorine, caustic soda, and the like at 80 to 90° during electrolysis, and therefore fluorine-containing polymers having high chemical resistance are used as materials of the cation exchange membrane.

But, with only such fluorine-containing polymers, the cation exchange membrane does not have sufficient mechanical strength as a cation exchange membrane, and therefore embedding a woven fabric comprising polytetrafluoroethylene (PTFE), or the like, as a reinforcement core material, in the membrane for strengthening, and the like are performed.

As electrolytic characteristics in electrolysis using this cation exchange membrane, high production efficiency with respect to the passed current (current efficiency) from the viewpoint of productivity, low electrolytic voltage from the viewpoint of economy, low impurity (common salt and the like) concentration in an alkali (caustic soda or the like) and no occurrence of damage to the membrane even in long term operation from the viewpoint of the quality of the product, and the like are desired.

For example, Patent Literature 1 proposes a technique of polishing a surface of an ion exchange membrane to expose a sacrifice core material and part of a reinforcement core material on the membrane surface to improve current efficiency and reduce the influence of a metal dissolved from a cathode during stop of electrolysis on the ion exchange membrane.

On the other hand, raised shapes are given to a fluorine-containing cation exchange membrane surface to improve alkali chloride aqueous solution supply properties. For example, in Patent Literature 2, Patent Literature 3, and the like, raised portion shapes are formed on the anode surface of a cation exchange membrane to improve alkali chloride aqueous solution supply properties, decrease impurities in a produced alkali hydroxide, and reduce damage to the cathode surface.

PRIOR ART LITERATURE

Patent Literature

[Patent Literature 1] Japanese Unexamined Patent Publication No. 06-128782

[Patent Literature 2] Japanese Patent No. 4573715
[Patent Literature 3] Japanese Patent No. 4708133

SUMMARY OF THE INVENTION

Problems to be Solved by the Invention

In the method for forming opening portions by a continuous roll polishing method before hydrolysis described in Patent Literature 1, raised portion shapes were scraped. As a result, a problem is that the cation exchange membrane described in Patent Literature 1 does not have raised portion shapes and therefore has poor anolyte supply properties. On the other hand, in the technique described in Patent Literatures 2 to 3, although raised portion shapes are formed on the surface of the membrane, there is room for further improvement from the viewpoint of impurity resistance and resistance to damage to the cathode surface.

The present invention has been made in view of the above circumstances, and it is an object of the present invention to provide a cation exchange membrane that has sufficient mechanical strength and at the same time has high impurity resistance, suffers little cathode surface damage, and exhibits stable electrolytic characteristics.

Solution to Problem

The present inventors have studied diligently over and over in order to solve the above problems, and as a result found that the above problems can be solved by providing a cation exchange membrane having a particular opening portion area ratio and at the same time having a particular raised portion density on one membrane surface, leading to the completion of the present invention.

Specifically, the present invention is as follows.

[1]

A cation exchange membrane comprising:

a membrane body comprising a fluorine-containing polymer having an ion exchange group; and a reinforcement core material arranged inside the membrane body, wherein raised portions having a height of 20 μm or more in cross-sectional view are formed on at least one surface of the membrane body, an arrangement density of the raised portions on the surface of the membrane body is 20 to 1500/cm$^2$, a plurality of opening portions are formed on the surface of the membrane body, and an opening area ratio, which is a proportion of a total area of the opening portions to an area of the surface of the membrane body, is in a range of 0.4 to 15%.

[2]

The cation exchange membrane according to [1], wherein an opening density of the opening portions on the surface of the membrane body is 10 to 1000/cm$^2$.

[3]

The cation exchange membrane according to [1] or [2], wherein an exposed area ratio calculated by the following formula is 5% or less:

the exposed area ratio (%)=(a sum of projected areas of exposed portions in which a part of the reinforcement core material is exposed, provided that the surface of the membrane body is seen in top view)/(a projected area of the surface of the membrane body)×100.

[4]

The cation exchange membrane according to any of [1] to [3], wherein the reinforcement core material comprises a fluorine-containing polymer.

[5]

The cation exchange membrane according to any of [1] to [4], wherein the membrane body has a first layer comprising a fluorine-containing polymer having a sulfonic acid group, and a second layer comprising a fluorine-containing polymer having a carboxylic acid group laminated on the first layer, and the opening portions are formed on a surface of the first layer.

[6]

The cation exchange membrane according to any of [1] to [5], further comprising a coating layer coating at least a part of at least one surface of the membrane body.

[7]

The cation exchange membrane according to any of [1] to [6], wherein the raised portions have at least one shape selected from a group consisting of a conical shape, a polygonal pyramid shape, a truncated cone shape, a truncated polygonal pyramid shape, and a hemispherical shape.

[8]

An electrolyzer comprising:

an anode;

a cathode; and the cation exchange membrane according to any of [1] to [7] arranged between the anode and the cathode.

Effect of the Invention

According to the present invention, it is possible to provide a cation exchange membrane that has sufficient mechanical strength and at the same time has high impurity resistance, suffers little cathode surface damage, and exhibits stable electrolytic characteristics.

BRIEF DESCRIPTION OF THE DRAWINGS

FIG. 1 shows a cross-sectional schematic view of the first embodiment of a cation exchange membrane according to the present embodiment.

FIG. 2 shows a simplified perspective view in which part of the first embodiment of the cation exchange membrane according to the present embodiment is cut out, used for explaining arrangement of opening portions and continuous holes.

FIG. 3 shows a simplified perspective view in which part of the first embodiment of the cation exchange membrane according to the present embodiment is cut out, used for explaining arrangement of reinforcement core materials.

FIG. 4 shows a partially enlarged view of the region A1 in FIG. 1.

FIG. 5 shows a partially enlarged view of the region A2 in FIG. 1.

FIG. 6 shows a partially enlarged view of the region A3 in FIG. 1.

FIG. 7 shows a conceptual diagram for explaining the aperture ratio of the cation exchange membrane according to the present embodiment.

FIG. 8 shows a cross-sectional schematic view of the second embodiment of the cation exchange membrane according to the present embodiment.

FIG. 9 shows a conceptual diagram for explaining the exposed area ratio of the cation exchange membrane according to the present embodiment.

FIG. 10 shows a cross-sectional schematic view of the third embodiment of the cation exchange membrane according to the present embodiment.

FIG. 11 shows a cross-sectional schematic view of the fourth embodiment of the cation exchange membrane according to the present embodiment.

FIG. 12 shows a schematic view for explaining a method for forming the continuous holes of the cation exchange membrane in the present embodiment.

FIG. 13 shows a schematic view of one embodiment of an electrolyzer according to the present embodiment.

MODE FOR CARRYING OUT THE INVENTION

A mode for carrying out the present invention (hereinafter referred to as "the present embodiment") will be described in detail below. The present invention is not limited to the present embodiment below, and various modifications can be made without departing from the spirit thereof. In the drawings, positional relationships such as top, bottom, left, and right are based on the positional relationships shown in the drawing unless otherwise noted. Further, the dimensional ratios in the drawings are not limited to the ratios shown.

[Cation Exchange Membrane]

A cation exchange membrane according to the present embodiment comprises a membrane body comprising a fluorine-containing polymer having an ion exchange group; and a reinforcement core material arranged inside the above membrane body, raised portions having a height of 20 μm or more in cross-sectional view are formed on at least one surface of the above membrane body, the arrangement density of the above raised portions on the above surface of the above membrane body is 20 to 1500/cm$^2$, a plurality of opening portions are formed on the above surface of the above membrane body, and the proportion of the total area of the above opening portions to the area of the above surface of the above membrane body (opening area ratio) is in the range of 0.4 to 15%. The cation exchange membrane according to the present embodiment is configured in this manner and therefore has sufficient mechanical strength and at the same time suffers little cathode surface damage and can exhibit stable electrolytic characteristics.

FIG. 1 shows a cross-sectional schematic view of the first embodiment of the cation exchange membrane in the present embodiment. FIG. 2 shows a simplified perspective view in which part of the first embodiment of the cation exchange membrane according to the present embodiment is cut out, used for explaining arrangement of opening portions and continuous holes, and FIG. 3 shows a simplified perspective view in which part of the first embodiment of the cation exchange membrane according to the present embodiment is cut out, used for explaining arrangement of reinforcement core materials. In FIGS. 2 to 3, raised portions described later are omitted. A cation exchange membrane 1 in the present embodiment is a cation exchange membrane comprising a membrane body 10 comprising a fluorine-containing polymer having an ion exchange group; and reinforcement core materials 12 arranged inside the above membrane body 10, wherein a plurality of raised portions 11 having a height of 20 μm or more in cross-sectional view are formed on at least one surface of the above membrane body 10, the arrangement density of the raised portions 11 on the above surface of the above membrane body is 20 to 1500/cm$^2$, a plurality of opening portions 102 are formed, continuous holes 104 that allow at least two of the above opening portions 102 to communicate with each other are formed inside the membrane body 10, and the proportion of the total area of the above opening portions 102 to the area of the above surface of the above membrane body 10 is in the range of 0.4 to 15%. In the cation exchange membrane 1 having such a structure, the influence of impurities generated during electrolysis on electrolytic characteristics is small, and stable electrolytic characteristics can be exhibited. Holes 106 are holes created by cutting out the cation exchange membrane 1.

(Fluorine-Containing Polymer)

The membrane body 10 should be one having the function of selectively allowing cations to permeate, and comprising a fluorine-containing polymer having an ion exchange group. Its configuration and material are not particularly limited, and preferred ones can be appropriately selected. The "fluorine-containing polymer having an ion exchange group" here refers to a fluorine-containing polymer having an ion exchange group or an ion exchange group precursor capable of forming an ion exchange group by hydrolysis. Examples thereof include a polymer comprising a main chain of a fluorinated hydrocarbon, having as a pendant side chain a functional group convertible into an ion exchange group by hydrolysis or the like, and being melt-processable. One example of a method for producing such a fluorine-containing polymer will be described below.

The fluorine-containing polymer can be produced, for example, by copolymerizing at least one monomer selected from the following first group and at least one monomer selected from the following second group and/or the following third group though not particularly limited. The fluorine-containing polymer can also be produced by homopolymerization of one monomer selected from any of the following first group, the following second group, and the following third group.

Examples of the monomers of the first group include, but are not limited to, vinyl fluoride compounds. Examples of the vinyl fluoride compounds include, but are not limited to, vinyl fluoride, tetrafluoroethylene, hexafluoropropylene, vinylidene fluoride, trifluoroethylene, chlorotrifluoroethylene, and perfluoro(alkyl vinyl ethers). Particularly when the cation exchange membrane 1 according to the present embodiment is used as a membrane for alkali electrolysis, the vinyl fluoride compound is preferably a perfluoro monomer, more preferably a perfluoro monomer selected from the group consisting of tetrafluoroethylene, hexafluoropropylene, and perfluoro(alkyl vinyl ethers).

Examples of the monomers of the second group include, but are not limited to, vinyl compounds having a functional group convertible into a carboxylic acid-type ion exchange group. Examples of the vinyl compounds having a functional group convertible into a carboxylic acid-type ion exchange group include, but are not limited to, monomers represented by $CF_2{=}CF(OCF_2CYF)_s{-}O(CZF)_t{-}COOR$ wherein s represents an integer of 0 to 2, t represents an integer of 1 to 12, Y and Z each independently represent F or $CF_3$, and R represents an alkyl group having 1 to 3 carbon atoms. Among these, compounds represented by $CF_2{=}CF(OCF_2CYF)_n{-}O(CF_2)_m{-}COOR$ are preferred, wherein n represents an integer of 0 to 2, m represents an integer of 1 to 4, Y represents F or $CF_3$, and R represents $CH_3$, $C_2H_5$, or $C_3H_7$.

Particularly when the cation exchange membrane 1 according to the present embodiment is used as a cation exchange membrane for alkali electrolysis, at least a perfluoro monomer is preferably used as the monomer of the first group. But, the alkyl group (see the above R) of the ester group is lost from the polymer at the time of hydrolysis, and therefore the alkyl group (R) need not be a perfluoroalkyl group in which all hydrogen atoms are replaced by fluorine atoms. Among these, for example, the monomers represented below are more preferred:

$CF_2{=}CFOCF_2{-}CF(CF_3)OCF_2COOCH_3$,
$CF_2{=}CFOCF_2CF(CF_3)O(CF_2)_2COOCH_3$,
$CF_2{=}CF[OCF_2{-}CF(CF_3)]_2O(CF_2)_2COOCH_3$,
$CF_2{=}CFOCF_2CF(CF_3)O(CF_2)_3COOCH_3$,
$CF_2{=}CFO(CF_2)_2COOCH_3$, and
$CF_2{=}CFO(CF_2)_3COOCH_3$.

Examples of the monomers of the third group include, but are not limited to, vinyl compounds having a functional group convertible into a sulfone-type ion exchange group. The vinyl compounds having a functional group convertible into a sulfone-type ion exchange group are not particularly limited, and, for example, monomers represented by $CF_2{=}CFO{-}X{-}CF_2{-}SO_2F$ are preferred, wherein X represents a perfluoro group. Specific examples of these include the monomers represented below:

$CF_2{=}CFOCF_2CF_2SO_2F$,
$CF_2{=}CFOCF_2CF(CF_3)OCF_2CF_2SO_2F$,
$CF_2{=}CFOCF_2CF(CF_3)OCF_2CF_2CF_2SO_2F$,
$CF_2{=}CF(CF_2)_2SO_2F$,
$CF_2{=}CFO[CF_2CF(CF_3)O]_2CF_2CF_2SO_2F$, and
$CF_2{=}CFOCF_2CF(CF_2OCF_3)OCF_2CF_2SO_2F$.

Among these, $CF_2{=}CFOCF_2CF(CF_3)OCF_2CF_2CF_2SO_2F$ and $CF_2{=}CFOCF_2CF(CF_3)OCF_2CF_2SO_2F$ are more preferred.

The copolymer obtained from these monomers can be produced by, for example, a polymerization method developed for homopolymerization and copolymerization of ethylene fluoride, particularly a general polymerization method used for tetrafluoroethylene. For example, in a non-aqueous method, a polymerization reaction can be performed in the presence of a radical polymerization initiator such as a perfluorocarbon peroxide or an azo compound under the conditions of a temperature of 0 to 200° C. and a pressure of 0.1 to 20 MPa using an inert solvent such as a perfluorohydrocarbon or a chlorofluorocarbon.

In the above copolymerization, the type of combination of the above monomers and their proportion are not particularly limited and are selected and determined depending on the type and amount of the functional group to be provided to the fluorine-containing polymer to be obtained, and the like. For example, when a fluorine-containing polymer containing only a carboxylate functional group is formed, at least one monomer should be selected from each of the first group and the second group and copolymerized. In addition, when a polymer containing only a sulfonyl fluoride functional group is formed, at least one monomer should be selected from each of the first group and the third group and copolymerized. Further, when a fluorine-containing polymer having a carboxylate functional group and a sulfonyl fluoride functional group is formed, at least one monomer should be selected from each of the first group, the second group, and the third group and copolymerized.

In this case, the target fluorine-containing polymer can also be obtained by separately preparing a copolymer comprising the monomers of the first group and the second group and a copolymer comprising the monomers of the first group and the third group, and then mixing the copolymers. The mixing proportion of the monomers is not particularly limited, and when the amount of the functional groups per unit polymer is increased, the proportion of the monomers selected from the second group and the third group should be increased.

The total ion exchange capacity of the fluorine-containing polymer is not particularly limited but is preferably 0.5 to 2.0 mg equivalent/g, more preferably 0.6 to 1.5 mg equivalent/g, as the dry resin. The total ion exchange capacity here refers to the equivalent of the exchange group per unit weight of the dry resin and can be measured by neutralization titration or the like.

As shown in FIG. 1, the membrane body 10 preferably comprises at least a first layer (sulfonic acid layer) 10*a* having a sulfonic acid group as an ion exchange group, and a second layer (carboxylic acid layer) 10*b* having a carboxylic acid group as an ion exchange group laminated on the first layer 10*a*. Usually, the cation exchange membrane 1 is arranged so that the first layer 10*a* that is a sulfonic acid layer is positioned on the anode side (see the arrow α) of an electrolyzer, and the second layer 10*b* that is a carboxylic acid layer is positioned on the cathode side (see the arrow β) of the electrolyzer. The first layer 10*a* is preferably composed of a material having low electrical resistance, and preferably has large membrane thickness from the viewpoint of membrane strength. The second layer 10*b* preferably has high anion exclusion properties even if it has small membrane thickness. The anion exclusion properties here refer to the property of trying to hinder entry and permeation of anions into and through the cation exchange membrane 1. By providing the membrane body 10 having such a layer structure, selective permeability for cations such as sodium ions tends to improve further. In the present embodiment, it is especially preferred that the membrane body has a first layer comprising a fluorine-containing polymer having a sulfonic acid group, and a second layer comprising a fluorine-containing polymer having a carboxylic acid group laminated on the first layer, and the opening portions are formed on the surface of the first layer.

Examples of the polymer used for the first layer (sulfonic acid layer) 10*a* having a sulfonic acid group as an ion exchange group include, but are not limited to, fluorine-containing polymers having a sulfonic acid group, among the above-described fluorine-containing polymers. Particularly $CF_2{=}CFOCF_2CF(CF_3)OCF_2CF_2SO_2F$ is preferred.

Examples of the polymer used for the second layer (carboxylic acid layer) 10*b* having a carboxylic acid group as an ion exchange group include, but are not limited to, fluorine-containing polymers having a carboxylic acid group, among the above-described fluorine-containing polymers. Particularly $CF_2{=}CFOCF_2CF(CF_3)O(CF_2)_2COOCH_3$ is preferred.

(Raised Portions)

As shown in FIG. 1, the plurality of raised portions 11 are formed on the surface of the membrane body 10. The raised portions in the present embodiment are formed on at least one surface of the membrane body and have a height of 20 μm or more in cross-sectional view, and their arrangement density on the surface of the membrane body is 20 to 1500/cm$^2$. The raised portions here refer to portions having a height of 20 μm or more from a reference point that is a point having the lowest height on the surface of the cation exchange membrane 1. The arrangement density of the raised portions per cm$^2$ of the surface of the cation exchange membrane 1 is 20 to 1500/cm$^2$, preferably 50 to 1200/cm$^2$, from the viewpoint of sufficiently supplying an electrolytic solution to the membrane. The height and arrangement density of the raised portions can be controlled in the above-described ranges, for example, by adopting preferred production conditions described later. In the above control, the production conditions described in Japanese Patent No. 4573715 (Patent Literature 2) and Japanese Patent No. 4708133 (Patent Literature 3) can also be adopted.

The height, shape, and arrangement density of the above-described raised portions can be measured and confirmed by the following methods respectively. First, a point having the lowest height on the membrane surface of an area of the cation exchange membrane 1000 μm square is taken as a reference. Then, portions having a height of 20 μm or more from the reference point are taken as raised portions. As the method for measuring the height, measurement is performed using "Color 3D Laser Microscope (VK-9710)" manufactured by KEYENCE. Specifically, a 10 cm×10 cm part is arbitrarily cut from the cation exchange membrane in a dry state, a smooth plate and the cathode side of the cation exchange membrane are fixed by a double-sided tape, and the smooth plate and the cation exchange membrane are set on the measurement stage so that the anode side of the cation exchange membrane is directed toward the measurement lens. By observing the shape of the cation exchange membrane surface in a measurement area 1000 μm square on each 10 cm×10 cm membrane, taking a point having the lowest height as a reference, and measuring height therefrom, the raised portions can be observed.

The arrangement density of the raised portions is a value obtained by arbitrarily cutting 10 cm×10 cm membranes in three parts from the cation exchange membrane, measuring in nine parts in a measurement area 1000 μm square on each of the 10 cm×10 cm membranes, and averaging the measured values.

The shape of the raised portions is not particularly limited, but the raised portions preferably have at least one shape selected from the group consisting of a conical shape, a polygonal pyramid shape, a truncated cone shape, a truncated polygonal pyramid shape, and a hemispherical shape. The hemispherical shape here also encompasses shapes referred to as a dome shape and the like.

(Opening Portions and Continuous Holes)

The plurality of opening portions 102 are formed on the surface of the membrane body 10, and the continuous holes 104 that allow the opening portions 102 to communicate with each other are formed inside the membrane body 10 (see FIG. 2). The continuous holes 104 refer to holes that can be flow paths for cations generated in electrolysis and an electrolytic solution. By forming the continuous holes 104 inside the membrane body 10, the mobility of cations generated in electrolysis and an electrolytic solution can be ensured. The shape of the continuous holes 104 is not particularly limited and can be appropriately made a preferred shape.

When the opening portions are formed on the membrane surface, and the continuous holes that allow the opening portions to communicate with each other are formed in the membrane, an electrolytic solution is supplied to the inside of the cation exchange membrane in electrolysis. Thus, the amount of water passing through the membrane with cations decreases, and therefore the concentration of the alkali chloride in the alkali hydroxide, the product, can be reduced. In addition, the concentration of impurities inside the membrane changes, and therefore the amount of impurities accumulated in the membrane can be reduced. In addition, when metal ions generated by dissolution of the cathode, and impurities contained in the electrolytic solution supplied to the cathode side of the membrane enter the inside of the membrane, they are easily discharged from the inside of the membrane due to formation of the opening portions on the membrane surface, and the amount of impurities accumulated can be reduced. In other words, the cation exchange membrane in the present embodiment is a membrane also having high resistance to, in addition to impurities present in an electrolytic solution on the anode side of the membrane, further impurities generated on the cathode side of the membrane.

It is known that when an alkali chloride aqueous solution is not sufficiently supplied, characteristic damage is generated in the layer of a membrane close to a cathode. The opening portions in the present embodiment can improve alkali chloride aqueous solution supply properties and reduce damage generated on the cathode surface of the membrane body.

The opening portions 102 formed on the surface of the membrane body 10 are parts of the continuous holes 104 being open on one surface of the membrane body 10. "Being open" here means that the continuous holes are open to the outside from the surface of the membrane body 10. For example, when the surface of the membrane body 10 is coated with a coating layer described later, opening regions in which the continuous holes 104 are open to the outside on the surface of the membrane body 10 after the coating layer is removed are referred to as opening portions.

The opening portions 102 should be formed on at least one surface of the membrane body 10 but may be formed on both surfaces of the membrane body 10. As long as the opening area ratio in the present embodiment is satisfied, the arrangement interval and shape of the opening portions 102 on the surface of the membrane body 10 are not particularly limited, and preferred conditions can be appropriately selected considering the shape and characteristics of the membrane body 10, operation conditions during electrolysis, and the like. Particularly in the case of the membrane body 10 having both the first layer 10*a* and the second layer 10*b*, the opening portions 102 are preferably formed on the surface of the first layer 10*a*. Impurities are often contained in an electrolytic solution supplied to the anode side in electrolysis, and therefore the opening portions 102 are preferably formed on the surface of the first layer 10*a* to be arranged on the anode side. Thus, the influence of impurities on the cation exchange membrane tends to be more reduced.

The continuous holes 104 are preferably formed so as to alternately pass on the first layer 10*a* sides ((a) side in FIG. 1) and second layer 10*b* sides ((β) side in FIG. 1) of the reinforcement core materials 12. By providing such a structure, an electrolytic solution and cations (for example, sodium ions) contained therein flowing through spaces in the continuous holes 104 can transfer between the anode side and cathode side of the membrane body 10. As a result, blocking of the flow of cations in the cation exchange membrane 1 in electrolysis is reduced, and therefore the electrical resistance of the cation exchange membrane 1 tends to be able to be further decreased.

Specifically, as shown in FIG. 1, the continuous hole 104 formed in the vertical direction in FIG. 1 in cross-sectional view is preferably alternately arranged on the first layer 10*a* side ((α) side in FIG. 1) and the second layer 10*b* side ((β) side in FIG. 1) with respect to the reinforcement core materials 12 whose cross sections are illustrated from the viewpoint of exhibiting more stable electrolytic characteristics and strength. Specifically, it is preferred that the continuous hole 104 is arranged on the first layer 10*a* side of the reinforcement core material 12 in a region A1, and the continuous hole 104 is arranged on the second layer 10*b* side of the reinforcement core material 12 in a region A4.

The continuous holes 104 are formed along the vertical direction and horizontal direction of the paper surface respectively in FIG. 2. In other words, the continuous holes 104 formed along the vertical direction in FIG. 2 allow the plurality of opening portions 102 formed on the surface of the membrane body 10 to communicate in the vertical direction. The continuous holes 104 formed along the horizontal direction in FIG. 2 allow the plurality of opening portions 102 formed on the surface of the membrane body 10 to communicate in the horizontal direction. In this manner, in the present embodiment, the continuous holes 104 may be formed along only one predetermined direction of the membrane body 10, but the continuous holes 104 are preferably arranged in both directions in the longitudinal direction and transverse direction of the membrane body 10 from the viewpoint of exhibiting more stable electrolytic characteristics.

The continuous holes 104 should allow at least two or more opening portions 102 to communicate, and the positional relationship between the opening portions 102 and the continuous holes 104, and the like are not limited. Here, examples of the opening portions 102 and the continuous holes 104 will be described using FIG. 4, FIG. 5, and FIG. 6. FIG. 4 shows a partially enlarged view of the region A1 in FIG. 1, FIG. 5 shows a partially enlarged view of the region A2 in FIG. 1, and FIG. 6 shows a partially enlarged view of the region A3 in FIG. 1. The regions A1 to A3 illustrated in FIGS. 4 to 6 are all regions in which the opening portions 102 are provided in the cation exchange membrane 1.

In the region A1 in FIG. 4, part of the continuous hole 104 formed along the vertical direction in FIG. 1 is open on the surface of the membrane body 10, and thus the opening portion 102 is formed. The reinforcement core material 12 is arranged at the back of the continuous hole 104. The parts in which the opening portions 102 are provided are backed with the reinforcement core materials 12, and thus the occurrence of cracks in the membrane starting from the opening portions when the membrane is bent can be suppressed, and the mechanical strength of the cation exchange membrane 1 tends to improve further.

In the region A2 in FIG. 5, part of the continuous hole 104 formed along the direction perpendicular to the paper surface of FIG. 1 (that is, the direction corresponding to the horizontal direction in FIG. 2) is exposed on the surface of the membrane body 10, and thus the opening portion 102 is formed. Further, the continuous hole 104 formed along the direction perpendicular to the paper surface of FIG. 1 crosses the continuous hole 104 formed along the vertical direction in FIG. 1. When the continuous holes 104 are formed along two directions (for example, the vertical direction and the horizontal direction in FIG. 2) in this manner, the opening portions 102 are preferably formed at points where the continuous holes 104 cross each other. Thus, an electrolytic solution is supplied to the continuous holes in both the vertical direction and the horizontal direction, and therefore the electrolytic solution is easily supplied to the inside of the entire cation exchange membrane. Thus, the concentration of impurities inside the membrane changes, and the amount of impurities accumulated in the membrane tends to be more reduced. In addition, when metal ions generated by dissolution of the cathode, and impurities contained in the electrolytic solution supplied to the cathode side of the membrane enter the inside of the membrane, both impurities carried through the continuous holes 104 formed along the vertical direction and impurities carried through the continuous holes 104 formed along the horizontal direction can be discharged outside from the opening portions 102, and also from such a viewpoint, the amount of impurities accumulated tends to be more reduced.

Further, the amount of water passing through the membrane with cations decreases, and therefore the concentration of the alkali chloride in the obtained alkali hydroxide tends to be more reduced.

In the region A3 in FIG. 6, part of the continuous hole 104 formed along the vertical direction in FIG. 1 is exposed on the surface of the membrane body 10, and thus the opening portion 102 is formed. Further, the continuous hole 104 formed along the vertical direction with respect to the paper surface of FIG. 1 crosses the continuous hole 104 formed along the direction perpendicular to the paper surface of FIG. 1 (that is, the direction corresponding to the horizontal direction in FIG. 2). Also in the region A3, as in the region A2, an electrolytic solution is supplied to the continuous holes in both the vertical direction and the horizontal direction, and therefore the electrolytic solution is easily supplied to the inside of the entire cation exchange membrane. Thus, the concentration of impurities inside the membrane changes, and the amount of impurities accumulated in the membrane tends to be more reduced. In addition, when metal ions generated by dissolution of the cathode, and impurities contained in the electrolytic solution supplied to the cathode side of the membrane enter the inside of the membrane, both impurities carried through the continuous holes 104 formed along the vertical direction and impurities carried through the continuous holes 104 formed along the horizontal direction can be discharged outside from the opening portions 102, and also from such a viewpoint, the amount of impurities accumulated tends to be more reduced. Further, the amount of water passing through the membrane with cations decreases, and therefore the concentration of the alkali chloride in the obtained alkali hydroxide tends to be more reduced.

(Reinforcement Core Materials)

The cation exchange membrane 1 according to the present embodiment has the reinforcement core materials 12 arranged inside the membrane body 10. The reinforcement core materials 12 are members that enhance the strength and dimensional stability of the cation exchange membrane 1. By arranging the reinforcement core materials 12 inside the membrane body 10, particularly expansion and contraction of the cation exchange membrane 1 can be controlled in the desired range. Such a cation exchange membrane 1 does not expand or contract more than necessary during electrolysis and the like and can maintain excellent dimensional stability for a long term.

The configuration of the reinforcement core materials 12 in the present embodiment is not particularly limited, and, for example, the reinforcement core materials may be formed by spinning yarns referred to as reinforcement yarns. The reinforcement yarns here refer to yarns that are members constituting the reinforcement core materials 12, can provide the desired dimensional stability and mechanical strength to the cation exchange membrane 1, and can be stably present in the cation exchange membrane 1. By using the reinforcement core materials 12 obtained by spinning such reinforcement yarns, better dimensional stability and mechanical strength can be provided to the cation exchange membrane 1.

The material of the reinforcement core materials 12 and the reinforcement yarns used for these is not particularly limited but is preferably a material having resistance to acids, alkalis, and the like, and is more preferably one comprising a fluorine-containing polymer from the viewpoint of providing long term heat resistance and chemical resistance. Examples of the fluorine-containing polymer include, but are not limited to, polytetrafluoroethylene (PTFE), tetrafluoroethylene-perfluoroalkyl vinyl ether copolymers (PFA), tetrafluoroethylene-ethylene copolymers (ETFE), tetrafluoroethylene-hexafluoropropylene copolymers, trifluorochloroethylene-ethylene copolymers, and vinylidene fluoride polymers (PVDF). Among these, polytetrafluoroethylene (PTFE) is preferred from the viewpoint of heat resistance and chemical resistance.

The yarn diameter of the reinforcement yarns used for the reinforcement core materials 12 is not particularly limited but is preferably 20 to 300 denier, more preferably 50 to 250 denier. The weave density of the reinforcement yarns (the fabric count per unit length) is not particularly limited but is preferably 5 to 50/inch. The form of the reinforcement core materials is not particularly limited, and, for example, a woven fabric, a nonwoven fabric, and a knitted fabric are used. Among these, a woven fabric is preferred. The thickness of the woven fabric is not particularly limited but is preferably 30 to 250 μm, more preferably 30 to 150 μm.

In the present embodiment, the reinforcement core materials 12 may be monofilaments or multifilaments. Yarns, slit yarns, and the like thereof are preferably used.

The weave and arrangement of the reinforcement core materials 12 in the membrane body 10 are not particularly limited, and preferred arrangement can be appropriately provided considering the size and shape of the cation exchange membrane 1, physical properties desired for the cation exchange membrane 1, the use environment, and the like. For example, the reinforcement core materials 12 may be arranged along one predetermined direction of the membrane body 10, but from the viewpoint of dimensional stability, it is preferred that the reinforcement core materials 12 are arranged along a predetermined first direction, and other reinforcement core materials 12 are arranged along a second direction substantially perpendicular to the first direction (see FIG. 3). By arranging the plurality of reinforcement core materials substantially orthogonally inside the membrane body 10, better dimensional stability and mechanical strength tend to be provided in many directions. For example, arrangement in which the reinforcement core materials 12 arranged along the longitudinal direction (warp yarns) and the reinforcement core materials 12 arranged along the transverse direction (weft yarns) are woven on the surface side of the membrane body 10 is preferred. Providing a plain weave in which warp yarns and weft yarns are driven and woven while being alternately raised and lowered, a leno weave in which two warp yarns are woven with weft yarns while being twisted, a basket weave in which into warp yarns aligned and arranged in groups of two or several, the same number of weft yarns are driven and woven, or the like is more preferred from the viewpoint of dimensional stability, mechanical strength, and the ease of production.

It is preferred that particularly, the reinforcement core materials 12 are arranged along both directions, the MD (Machine Direction) and TD (Transverse Direction) of the cation exchange membrane 1. In other words, the reinforcement core materials 12 are preferably plain-woven in the MD and the TD. Here, the MD refers to the direction in which the membrane body 10 and various core materials (for example, the reinforcement core materials 12, reinforcement yarns, and sacrifice yarns described later) are carried in a cation exchange membrane production step described later (flow direction), and the TD refers to the direction substantially perpendicular to the MD. Yarns woven along the MD are referred to as MD yarns, and yarns woven along the TD are referred to as TD yarns. Usually, the cation exchange membrane 1 used for electrolysis is rectangular, and in many cases, the longitudinal direction is the MD, and the width direction is the TD. By weaving the reinforcement core materials 12 that are MD yarns and the reinforcement core materials 12 that are TD yarns, better dimensional stability and mechanical strength tend to be provided in many directions.

The arrangement interval of the reinforcement core materials 12 is not particularly limited, and preferred arrangement can be appropriately provided considering physical properties desired for the cation exchange membrane 1, the use environment, and the like.

(Aperture Ratio)

The aperture ratio for the reinforcement core materials 12 is not particularly limited but is preferably 30% or more, more preferably 50% or more and 90% or less. The aperture ratio is preferably 30% or more from the viewpoint of the electrochemical properties of the cation exchange membrane 1 and preferably 90% or less from the viewpoint of the mechanical strength of the cation exchange membrane 1.

The aperture ratio here refers to the proportion (B/A) between the projected area of either one surface of the membrane body 10 (A) and the total area of the surface through which substances such as ions (an electrolytic solution and cations (for example, sodium ions) contained therein) can pass (B). The total area of the surface through which substances such as ions can pass (B) can refer to the total of the projected areas of regions in which in the cation exchange membrane 1, cations, an electrolytic solution, and the like are not blocked by the reinforcement core materials 12 and the like contained in the cation exchange membrane 1.

FIG. 7 shows a conceptual diagram for explaining the aperture ratio of the cation exchange membrane according to the present embodiment. In FIG. 7, part of the cation exchange membrane 1 is enlarged, and only arrangement of the reinforcement core materials 12 in the region is illustrated, and illustration of other members is omitted. Here, by subtracting the total of the projected areas of the reinforcement core materials 12 (C) from the projected area of the cation exchange membrane comprising the reinforcement core materials 12 arranged along the longitudinal direction and the reinforcement core materials 12 arranged in the transverse direction (A), the total area of regions through which substances such as ions can pass (B) in the area of the above-described region (A) can be obtained. In other words, the aperture ratio can be obtained by the following formula (I):

$$\text{aperture ratio}=(B)/(A)=((A)-(C))/(A) \quad \text{(I)}$$

Among these reinforcement core materials 12, a particularly preferred form is preferably tape yarns or highly oriented monofilaments comprising PTFE from the viewpoint of chemical resistance and heat resistance. Specifically, reinforcement core materials forming a plain weave in which 50 to 300 denier tape yarns obtained by slitting a high strength porous sheet comprising PTFE into a tape form, or 50 to 300 denier highly oriented monofilaments comprising PTFE are used and which has a weave density of 10 to 50 yarns or monofilaments/inch and has a thickness in the range of 50 to 100 μm are more preferred. The aperture ratio of a cation exchange membrane comprising such reinforcement core materials is further preferably 60% or more.

The shape of the reinforcement yarns is not particularly limited. Examples thereof include round yarns and tape yarns. These shapes are not particularly limited.

(Opening Area Ratio)

In the cation exchange membrane 1 in the present embodiment, the proportion of the total area of the opening portions 102 to the area of the surface of the membrane body 10 on which the opening portions 102 are formed (opening area ratio) is in the range of 0.4 to 15%. By controlling the opening area ratio in such a range, the influence of impurities in an electrolytic solution on electrolytic characteristics is small, and stable electrolytic characteristics can be exhibited. In a case where the opening area ratio is less than 0.4%, when impurities contained in an electrolytic solution enter the cation exchange membrane 1 and are accumulated inside the membrane body 10, an increase in electrolytic voltage, a decrease in current efficiency, and a decrease in the purity of the obtained product are caused. When the opening area ratio in the present embodiment is more than 15%, the strength of the membrane decreases, and exposure of the reinforcement core materials increases. The cation exchange membrane 1 in the present embodiment has a high opening area ratio, and therefore even if impurities are accumulated inside the membrane body 10, a flow in which impurities are discharged out of the membrane from the continuous holes 104 through the opening portions 102 can be promoted. Therefore, the influence of impurities on electrolytic characteristics is low, and stable electrolytic characteristics can be exhibited for a long term.

Particularly in alkali chloride electrolysis, impurities such as metal compounds, metal ions, and organic substances are contained in an alkali chloride used as an anolyte and an alkali hydroxide used as a catholyte, and therefore the influence of such impurities on electrolytic voltage and current efficiency in the alkali chloride electrolysis is large. But, by using the cation exchange membrane 1 in the present embodiment, an electrolytic solution is supplied to the inside of the cation exchange membrane in electrolysis. Thus, the concentration of impurities inside the membrane changes, and therefore the amount of impurities accumulated in the membrane can be reduced. In addition, when metal ions generated by dissolution of the cathode, and impurities contained in the electrolytic solution supplied to the cathode side of the membrane enter the inside of the membrane, the above-described impurities can be allowed to permeate outside the membrane body 10 through the opening portions 102 and the continuous holes 104 without hindrance. Therefore, the influence of impurities generated in alkali chloride electrolysis on electrolytic characteristics can be reduced, and stable electrolytic characteristics can be maintained for a long term. Further, an increase in impurity (alkali chloride and the like) concentration in an alkali hydroxide that is a product can also be suppressed. In the cation exchange membrane 1 in the present embodiment, the opening area ratio for the opening portions 102 is preferably 0.5 to 10%, more preferably 0.5 to 5%, from the viewpoint of reducing the influence of impurities on electrolytic characteristics and keeping the strength of the membrane constant. The above opening area ratio can be confirmed by a method described in Examples and can be controlled in the above-described range, for example, by adopting preferred production conditions described later.

In the present embodiment, the opening area ratio for the opening portions is the proportion of the area of the opening portions to the projected area when the cation exchange membrane is seen in top view on the surface of the cation exchange membrane.

(Opening Density)

In the cation exchange membrane 1 in the present embodiment, the opening density of the opening portions 102 on the surface of the membrane body 10 is not particularly limited but is preferably 10 to 1000/cm$^2$, more preferably 20 to 800/cm$^2$. The opening density here refers to the number of the opening portions 102 formed on 1 $cm^2$ of the surface of the membrane body 10 on which the opening portions 102 are formed. 1 $cm^2$ of the surface of the membrane body 10 is the projected area when the membrane body 10 is seen in top view. When the opening density of the opening portions 102 is $10/cm^2$ or more, the average area per opening portion 102 can be made moderately small and therefore can be made sufficiently smaller than the size of a hole (pinhole) from which a crack, one cause of a decrease in the strength of the cation exchange membrane 1, can occur. When the opening density of the opening portions 102 is $1000/cm^2$ or less, the average area per opening portion 102 is such a sufficient size that metal ions and cations contained in an electrolytic solution can enter the continuous holes 104, and therefore metal ions and cations tend to be able to be more efficiently supplied to or allowed to permeate the cation exchange membrane 1. The above opening density can be controlled in the above-described range, for example, by adopting preferred production conditions described later.

(Exposed Area Ratio)

FIG. 8 shows a cross-sectional schematic view of the second embodiment of the cation exchange membrane according to the present embodiment. In the present embodiment, as shown in a cation exchange membrane 2 in FIG. 8, exposed portions A5 in which parts of reinforcement core materials 22 are exposed may be formed on the surface of a membrane body 20 on which raised portions 21 and opening portions 202 are formed. In the present embodiment, the number of the exposed portions is preferably smaller. In other words, the exposed area ratio described later is preferably 5% or less, more preferably 3% or less, and further preferably 1% or less, and an exposed area ratio of 0%, that is, no exposed portions being formed, is most preferred. Here, the exposed portions A5 refer to sites in which the reinforcement core materials 22 are exposed outside from the surface of the membrane body 20. For example, when the surface of the membrane body 20 is coated with a coating layer described later, the exposed portions A5 refer to regions in which the reinforcement core materials 22 are exposed outside on the surface of the membrane body 20 after the coating layer is removed. When the exposed area ratio is 5% or less, an increase in electrolytic voltage is suppressed, and an increase in the concentration of chloride ions in an obtained alkali hydroxide tends to be more suppressed. The above exposed area ratio is calculated by the following formula and can be controlled in the above-described range, for example, by adopting preferred production conditions described later:

the exposed area ratio (%)=(the sum of the projected areas of the exposed portions in which parts of the above reinforcement core materials are exposed when the above surface of the above membrane body is seen in top view)/(the projected area of the above surface of the above membrane body)×100.

In the present embodiment, the reinforcement core materials 22 preferably comprise a fluorine-containing polymer such as polytetrafluoroethylene (PTFE). When the reinforcement core materials 22 composed of a fluorine-containing polymer are exposed on the surface of the membrane body 20, the surfaces of the exposed portions A5 may exhibit hydrophobicity. When electrolysis-causing gas in a dissolved state and cations are adsorbed on the hydrophobic exposed portions, membrane permeation of cations can be inhibited. In such a case, the electrolytic voltage increases, and the concentration of chloride ions in the obtained alkali hydroxide can increase. In the present embodiment, by setting the exposed area ratio at 5% or less, the abundance of the hydrophobic exposed portions can be in a moderate range, and the increase in electrolytic voltage and the increase in chloride ions in the alkali hydroxide described above tend to be effectively suppressed.

Further, impurities in an electrolytic solution such as electrolysis-causing gas in a dissolved state and metal ions attach to the exposed portions, enter and permeate the inside of the membrane body 20, and can be impurities in caustic soda. In the present embodiment, by setting the exposed area ratio at 3% or less, adsorption, entry, and permeation of impurities tend to be able to be more effectively suppressed, and therefore higher purity caustic soda tends to be able to be produced.

Particularly when the above-described opening area ratio is 0.4 to 15% and the above-described exposed area ratio is 5% or less in the cation exchange membrane 2 in the present embodiment, a decrease in current efficiency due to impurities can be further suppressed, and in the case of alkali electrolysis, the impurity concentration in caustic soda that is the product tends to be maintained lower. Further, an increase in electrolytic voltage is also suppressed, and therefore more stable electrolytic characteristics tend to be able to be exhibited.

In the present embodiment, the exposed area ratio for the exposed portions is the sum of the projected areas of the exposed portions formed in the reinforcement core materials to the sum of the projected areas of the reinforcement core materials when seen in top view, and is an indicator showing to what extent the reinforcement core materials contained in the cation exchange membrane are exposed. Therefore, the exposed area ratio for the exposed portions can also be directly calculated by obtaining the projected areas of the reinforcement core materials and the projected areas of the exposed portions but can also be calculated by the following formula (II) using the above-described aperture ratio. Here, a more specific description will be given with reference to a drawing. FIG. 9 shows a conceptual diagram for explaining the exposed area ratio of the cation exchange membrane 2 according to the present embodiment. In FIG. 9, in a state in which the cation exchange membrane 2 is seen in top view, part thereof is enlarged, and only arrangement of the reinforcement core materials 22 is illustrated, and illustration of other members is omitted. In FIG. 9, a plurality of the exposed portions A5 are formed on the surfaces of the reinforcement core materials 22 arranged along the longitudinal direction and the reinforcement core materials 22 arranged along the transverse direction. Here, the sum of the projected areas of the exposed portions A5 in a top view state is S1, and the sum of the projected areas of the reinforcement core materials 22 is S2. Then, the exposed area ratio is represented by S1/S2, and the formula (II) can be derived by using the formula (I), as shown below.

$$\text{Exposed area ratio}=S1/S2 \text{ holds.}$$

Here, based on the above formula (I), $$S2=C=A-B=A(1-B/A)=A(1-\text{aperture ratio})$$

is obtained, and therefore $$\text{exposed area ratio}=S1/(A(1-\text{aperture ratio})) \quad \text{(II)}$$

is obtained.

S1: the sum of the projected areas of the exposed portions A5

S2: the sum of the projected areas of the reinforcement core materials 22

A: the projected area of the cation exchange membrane comprising the reinforcement core materials 22 arranged along the longitudinal direction and the reinforcement core materials 12 (22) arranged in the transverse direction (see FIG. 7)

B: the total area of regions through which substances such as ions can pass (see FIG. 7)

C: the total area of the reinforcement core materials 22

As shown in FIG. 8, in the cation exchange membrane 2 in the present embodiment, the raised portions 21 having a height of 20 μm or more in cross-sectional view are formed on the surface of the membrane body 20 on which the opening portions 202 are formed. In the present embodiment, the membrane body 20 preferably has the raised portions 21 on the surface having the opening portions 202 when the direction perpendicular to the surface of the membrane body 20 is the height direction (for example, see the arrow α and the arrow β in FIG. 8). Particularly when a first layer (sulfonic acid layer) 20*a* has the opening portions 202 and the raised portions 21, an electrolytic solution is sufficiently supplied to the membrane body 20 in electrolysis, and therefore the influence of impurities can be more reduced. The opening portions 202, the exposed portions, and the raised portions 21 are more preferably formed on the surface of the layer comprising a fluorine-containing polymer having a sulfonic acid group. Usually, for the purpose of decreasing electrolytic voltage, a cation exchange membrane is used in a state of being in close contact with an anode. But, when the cation exchange membrane and the anode come into close contact with each other, an electrolytic solution (anolyte such as brine) tends to be difficult to supply. Therefore, when raised portions are formed on a surface of the cation exchange membrane, the close contact between the cation exchange membrane and the anode can be suppressed, and therefore the electrolytic solution can be smoothly supplied. As a result, metal ions, other impurities, and the like can be prevented from being accumulated in the cation exchange membrane, the concentration of chloride ions in the obtained alkali hydroxide is reduced, and damage to the cathode surface of the membrane can be suppressed.

(Coating Layer)

The cation exchange membrane in the present embodiment preferably further comprises a coating layer coating at least a part of at least one surface of the membrane body from the viewpoint of preventing gas from attaching to the cathode side surface and the anode side surface during electrolysis. FIG. 10 shows a cross-sectional schematic view of the third embodiment of the cation exchange membrane in the present embodiment. A cation exchange membrane 3 has a membrane body 30 having a first layer 30*a* that is a sulfonic acid layer, and a second layer 30*b* that is a carboxylic acid layer laminated on the first layer 30*a*, and reinforcement core materials 32 arranged inside the membrane body 30, a plurality of raised portions 31 and a plurality of opening portions 302 are formed on the surface of the membrane body 30 on the first layer side (see the arrow α), and continuous holes 304 that allow at least two opening portions 302 to communicate with each other are formed inside the membrane body 30. Further, the surface of the membrane body 30 on the first layer side (see the arrow α) is coated with a coating layer 34*a*, and the surface of the membrane body 30 on the second layer side (see the arrow β) is coated with a coating layer 34*b*. In other words, the cation exchange membrane 3 is obtained by coating the surfaces of the membrane body of the cation exchange membrane 1 shown in FIG. 1 with coating layers. By coating the surfaces of the membrane body 30 with such coating layers 34*a* and 34*b*, gas generated in electrolysis can be prevented from attaching to the membrane surfaces. Thus, the cation membrane permeability can be further improved, and therefore the electrolytic voltage tends to be further reduced.

The coating layer 34*a* may completely coat the raised portions 31 and the opening portions 302 or may not completely coat the raised portions 31 and the opening portions 302. In other words, the cation exchange membrane 3 may be in a state in which the raised portions 31 and the opening portions 302 are visible from the surface of the coating layer 34*a*.

The material constituting the coating layers 34*a* and 34*b* is not particularly limited but preferably comprises inorganic matter from the viewpoint of preventing attachment of gas. Examples of the inorganic matter include, but are not limited to, zirconium oxide and titanium oxide. The method for forming the coating layers 34*a* and 34*b* on the surfaces of the membrane body 30 is not particularly limited, and a known method can be used. Examples of the method include a method of applying by a spray or the like a liquid obtained by dispersing fine particles of an inorganic oxide in a binder polymer solution (spray method). Examples of the binder polymer include, but are not limited to, vinyl compounds having a functional group convertible into a sulfone-type ion exchange group. The application conditions are not particularly limited and can be, for example, using a spray at 60° C. Examples of methods other than the spray method include, but are not limited to, roll coating.

The coating layer 34*a* is laminated on the surface of the first layer 30*a* that is a layer comprising a fluorine-containing polymer having a sulfonic acid group (sulfonic acid layer), but in the present embodiment, the opening portions 302 should be open on a surface of the membrane body 30 and need not necessarily be open on the surface of the first layer 30*a*.

The coating layer 34*a* or 34*b* should coat at least one surface of the membrane body 30. Therefore, for example, the coating layer 34*a* may be provided on only the surface of the first layer 30*a*, or the coating layer 34*b* may be provided on only the surface of the second layer 30*b*. In the present embodiment, from the viewpoint of preventing attachment of gas, both surfaces of the membrane body 30 are preferably coated with the coating layers 34*a* and 34*b*.

The coating layers 34*a* and 34*b* should coat at least parts of the surfaces of the membrane body 30 and need not necessarily coat all the surfaces, but from the viewpoint of preventing attachment of gas, all surfaces of the membrane body 30 are preferably coated with the coating layers 34*a* and 34*b*.

The average thickness of the coating layers 34*a* and 34*b* is preferably 1 to 10 μm from the viewpoint of preventing attachment of gas and from the viewpoint of electrical resistance increase due to thickness.

The cation exchange membrane 3 is obtained by coating the surfaces of the cation exchange membrane 1 shown in FIG. 1 with the coating layers 34*a* and 34*b*, and for members and configurations other than the coating layers 34*a* and 34*b*, the members and the configurations already described as the cation exchange membrane 1 can be similarly adopted.

FIG. 11 shows a cross-sectional schematic view of the fourth embodiment of the cation exchange membrane in the present embodiment. A cation exchange membrane 4 has a membrane body 40 having a first layer 40*a* that is a sulfonic acid layer, and a second layer 40*b* that is a carboxylic acid layer laminated on the first layer 40*a*, and reinforcement core materials 42 arranged inside the membrane body 40, a plurality of raised portions 41 and a plurality of opening portions 402 are formed on the surface of the membrane body 40 on the first layer side (see the arrow α), and continuous holes 404 that allow at least two opening portions 402 to communicate with each other are formed inside the membrane body 40, and exposed portions A5 in which parts of the reinforcement core materials 42 are exposed are formed on the surface of the membrane body 40 on which the opening portions 402 are formed. Further, the surface of the membrane body 40 on the first layer side (see the arrow α) is coated with a coating layer 44*a*, and the surface of the membrane body 40 on the second layer side (see the arrow β) is coated with a coating layer 44*b*. In other words, the cation exchange membrane 4 is obtained by coating the surfaces of the membrane body of the cation exchange membrane 2 shown in FIG. 8 with coating layers. By coating the surfaces of the membrane body 40 with such coating layers 44*a* and 44*b*, gas generated in electrolysis can be prevented from attaching to the membrane surfaces. Thus, the cation membrane permeability can be further improved, and therefore the electrolytic voltage tends to be further reduced.

In the exposed portions A5, the reinforcement core materials 42 should be exposed at least on the surface of the membrane body 40 and need not be exposed on the surface of coating layer 44*a*.

The cation exchange membrane 4 is obtained by coating the surfaces of the cation exchange membrane 2 shown in FIG. 8 with the coating layers 44*a* and 44*b*, and for members and configurations other than the coating layers 44*a* and 44*b*, the members and the configurations already described as the cation exchange membrane 2 can be similarly adopted. For the coating layers 44*a* and 44*b*, the members and the configurations described as the coating layers 34*a* and 34*b* used in the cation exchange membrane 3 shown in FIG. 10 can be similarly adopted.

[Method for Producing Cation Exchange Membrane]

Examples of a preferred method for producing the cation exchange membrane according to the present embodiment include a method having the following (1) to (6) steps:

(1) the step of producing a fluorine-containing polymer having an ion exchange group or an ion exchange group precursor capable of forming an ion exchange group by hydrolysis, (2) the step of weaving at least a plurality of reinforcement core materials, and sacrifice yarns having the property of dissolving in an acid or an alkali, and forming continuous holes, to obtain a strengthening material in which the sacrifice yarns are arranged between the reinforcement core materials adjacent to each other, (3) the step of forming into a film the above fluorine-containing polymer having an ion exchange group or an ion exchange group precursor capable of forming an ion exchange group by hydrolysis, to obtain a film, (4) the step of embedding the above strengthening material in the above film to obtain a membrane body inside which the above strengthening material is arranged, (5) the step of hydrolyzing the ion exchange group precursor of the fluorine-containing polymer with the acid or the alkali to obtain an ion exchange group, and at the same time dissolving the above sacrifice yarns to form continuous holes inside the above membrane body (hydrolysis step), and (6) the step of polishing a membrane surface to form opening portions on the membrane surface of the above membrane body.

According to the above method, by controlling the treatment conditions such as the temperature, the pressure, and the time during the embedding, in the embedding in the (4) step, a membrane body on which the desired raised portions are formed and the desired opening portions are to be formed can be obtained. In the (5) step, by dissolving the sacrifice yarns arranged inside the membrane body, continuous holes can be formed inside the membrane body, and in the (6) step, opening portions can be formed on a membrane surface, and thus the cation exchange membrane can be obtained. Each step will be described in more detail below.

(1) Step: Production of Fluorine-Containing Polymer

In the present embodiment, the fluorine-containing polymer having an ion exchange group or an ion exchange group precursor capable of forming an ion exchange group by hydrolysis is obtained by appropriately polymerizing the above-described monomers as described above. In order to control the ion exchange capacity of the fluorine-containing polymer, the mixing ratio of the monomers that are starting materials, and the like should be adjusted in the fluorine-containing polymer production step.

(2) Step: Step of Obtaining Strengthening Material

In the present embodiment, the strengthening material is composed of reinforcement core materials and sacrifice yarns and is, for example, but is not limited to, a woven fabric obtained by weaving reinforcement yarns and sacrifice yarns. When the strengthening material is embedded in the membrane, the reinforcement yarns form reinforcement core materials, and the sacrifice yarns form continuous holes by dissolving in the (5) step described later. The amount of the sacrifice yarns contained is preferably 10 to 80% by mass of the entire strengthening material, more preferably 30 to 70% by mass. Alternatively, monofilaments or multifilaments having a thickness of 20 to 50 denier and comprising polyvinyl alcohol, and the like are also preferred.

By adjusting the shapes and arrangement of the reinforcement core materials, the sacrifice yarns, and the like in the (2) step, the opening area ratio, the exposed area ratio, the opening density, arrangement of the continuous holes, and the like can be controlled. For example, when the thickness of the sacrifice yarns is increased, the sacrifice yarns are easily positioned in the vicinity of the surface of the membrane body in the (4) step described later, and the opening portions are easily formed by dissolution of the sacrifice yarns in the (5) step described later and polishing the surface in the (6) step.

By controlling the number of sacrifice yarns, the opening density can also be controlled. Similarly, when the thickness of the reinforcement yarns is increased, the reinforcement yarns easily protrude outside from the surface of the membrane body and exposed portions are easily formed in the (6) step described later.

Further, the aperture ratio for the reinforcement core materials described above can be controlled, for example, by adjusting the thickness of the reinforcement core materials and mesh. In other words, the aperture ratio tends to decrease when the reinforcement core materials are thickened, and the aperture ratio tends to increase when the reinforcement core materials are thinned. The aperture ratio tends to decrease when the mesh is increased, and the aperture ratio tends to increase when the mesh is decreased. From the viewpoint of increasing electrolytic characteristics more, the aperture ratio is preferably increased as described above, and from the viewpoint of ensuring strength, the aperture ratio is preferably decreased.

(3) Step: Film Forming Step

In the (3) step, the fluorine-containing polymer obtained in the (1) step is formed into a film using an extruder. The film may be a single-layer structure, a two-layer structure of a sulfonic acid layer and a carboxylic acid layer as described above, or a multilayer structure of three layers or more. The film forming method is not particularly limited. Examples thereof include the following:

A method of separately forming into films fluorine-containing polymers constituting layers.

A method of forming into a composite film fluorine-containing polymers constituting two layers, a carboxylic acid layer and a sulfonic acid layer, by coextrusion, and separately forming into a film a fluorine-containing polymer constituting another sulfonic acid layer.

Coextrusion contributes to an increase in adhesive strength at the interface and therefore is preferred.

(4) Step: Step of Obtaining Membrane Body

In the (4) step, the strengthening material obtained in the (2) step is embedded inside the film obtained in the (3) step to obtain a membrane body in which the strengthening material is contained.

Examples of the embedding method include, but are not limited to, a method of laminating the strengthening material and the film in this order on a flat plate or a drum having a heat source and/or a vacuum source inside and having a large number of pores on the surface via heat-resistant release paper having air permeability, and integrating the strengthening material and the film at a temperature at which the fluorine-containing polymer of the film melts while removing the air between the layers by a reduced pressure.

Examples of the embedding method in the case of a three-layer structure of two sulfonic acid layers and a carboxylic acid layer include, but are not limited to, a method of laminating release paper, a film constituting a sulfonic acid layer, the strengthening material, a film constituting a sulfonic acid layer, and a film constituting a carboxylic acid layer in this order on a drum and integrating them, or a method of laminating release paper, a film constituting a sulfonic acid layer, the strengthening material, and a composite film in which a sulfonic acid layer is directed toward the strengthening material side in this order and integrating them.

Examples of the embedding method when a composite membrane that is a multilayer structure of three layers or more is formed include, but are not limited to, a method of laminating release paper, a plurality of films constituting layers, the strengthening material, and a plurality of films constituting layers in this order on a drum and integrating them. When a multilayer structure of three layers or more is formed, adjustment is preferably performed so that a film constituting a carboxylic acid layer is laminated at a position farthest from the drum, and a film constituting a sulfonic acid layer is laminated at a position close to the drum.

In the method of integration under a reduced pressure, the thickness of the third layer on the strengthening material tends to be large compared with a pressing method. The variations of lamination described here are examples, and coextrusion can be performed after a preferred lamination pattern (for example, the combination of layers) is appropriately selected considering the desired layer configuration of the membrane body and physical properties, and the like.

It is also possible to further interpose a layer containing both a carboxylate functional group and a sulfonyl fluoride functional group between the above-described sulfonic acid layer and carboxylic acid layer, and to use instead of the sulfonic acid layer a layer containing both a carboxylate functional group and a sulfonyl fluoride functional group, for the purpose of further increasing the electrical characteristics of the cation exchange membrane according to the present embodiment. The method for producing a fluorine-containing polymer forming this layer may be a method of separately producing a polymer containing a carboxylate functional group and a polymer containing a sulfonyl fluoride functional group, and then mixing them, or a method of using a copolymer obtained by copolymerizing both a monomer containing a carboxylate functional group and a monomer containing a sulfonyl fluoride functional group.

(5) Step: Hydrolyzing Step

In the (5) step, the sacrifice yarns contained in the membrane body are dissolved and removed with the acid or the alkali to form continuous holes in the membrane body. The sacrifice yarns have solubility in the acid or the alkali in the cation exchange membrane production step and an electrolysis environment, and therefore the sacrifice yarns are dissolved from the membrane body with the acid or the alkali, and thus continuous holes are formed at the sites. In this manner, a cation exchange membrane in which continuous holes are formed in a membrane body can be obtained. The sacrifice yarns may remain in the continuous holes without being completely dissolved and removed. When electrolysis is performed, the sacrifice yarns remaining in the continuous holes may be dissolved and removed with an electrolytic solution.

The acid or the alkali used in the (5) step should dissolve the sacrifice yarns, and its type is not particularly limited. Examples of the acid include, but are not limited to, hydrochloric acid, nitric acid, sulfuric acid, acetic acid, and fluorine-containing acetic acid. Examples of the alkali include, but are not limited to, potassium hydroxide and sodium hydroxide.

Here, the step of dissolving the sacrifice yarns to form continuous holes will be described in more detail. FIG. 12 shows a schematic view for explaining a method for forming the continuous holes of the cation exchange membrane in the present embodiment. In FIG. 12, only reinforcement core materials 52 and sacrifice yarns 504*a* (continuous holes 504 formed from the sacrifice yarns 504*a*) are illustrated, and illustration of other members such as a membrane body is omitted. First, the reinforcement core materials 52 and the sacrifice yarns 504*a* are woven into a strengthening material 5. Then, in the (5) step, the sacrifice yarns 504*a* dissolve, and thus the continuous holes 504 are formed.

According to the above method, the way of knitting the reinforcement core materials 52 and the sacrifice yarns 504*a* should be adjusted according to how the reinforcement core materials 52, the continuous holes 504, and opening portions (not illustrated) are arranged inside the membrane body of the cation exchange membrane, and therefore the above method is simple. In FIG. 12, the plain-woven strengthening material 5 in which the reinforcement core materials 52 and the sacrifice yarns 504*a* are knitted along both directions, the longitudinal direction and the transverse direction, on the paper surface is illustrated, but the arrangement of the reinforcement core materials 52 and the sacrifice yarns 504*a* in the strengthening material 5 can be changed as needed.

In the (5) step, it is also possible to hydrolyze the membrane body obtained in the (4) step described above, to introduce an ion exchange group into the ion exchange group precursor.

In the method of exposing the sacrifice core materials and the reinforcement core materials on the surface of the cation exchange membrane by polishing in the (6) step, only the polymer on the continuous holes having poor wear resistance is selectively removed, and opening portions can be efficiently formed without greatly increasing the exposed area ratio for the reinforcement core materials. According to the method for producing the cation exchange membrane according to the present embodiment, the opening area ratio for the opening portions can be increased, and the exposed area ratio for the exposed portions can be decreased. Examples of the polishing method include, but are not limited to, a method of bringing a polishing roller into contact with the membrane running, and rotating the polishing roller at a speed faster than the membrane running speed or in the direction opposite to the membrane running direction. At this time, as the relative speed between the polishing roller and the membrane increases, and as the holding angle of the polishing roller increases, and as the running tension increases, the opening area ratio for the opening portions increases, but the exposed area ratio for the exposed portions also increases. Therefore, the relative speed between the polishing roller and the membrane is preferably 50 m/h to 1000 m/h.

The method for forming raised portions on the surface of the membrane body in the cation exchange membrane according to the present embodiment is not particularly limited, and a known method for forming raised portions on a resin surface can also be adopted. Specific examples of the method for forming raised portions on the surface of the membrane body in the present embodiment include a method of embossing the surface of the membrane body. For example, the above raised portions can be formed by using previously embossed release paper when integrating the above-described film, strengthening material, and the like.

According to the method for producing the cation exchange membrane according to the present embodiment, the opening portions and the exposed portions are formed by polishing in the wet state after hydrolysis, and therefore the polymer of the membrane body has sufficient flexibility, and therefore the raised portion shape is not lost. When the raised portions are formed by embossing, control of the height and arrangement density of the raised portions can be performed by controlling the embossed shape (the shape of release paper) to be transferred.

After the above-described (1) step to (6) step, the above-described coating layer may be formed on the surface of the obtained cation exchange membrane.

[Electrolyzer]

The cation exchange membrane in the present embodiment can be used as an electrolyzer using this. FIG. 13 shows a schematic view of one embodiment of an electrolyzer according to the present embodiment. An electrolyzer 100 in the present embodiment comprises at least an anode 200, a cathode 300, and a cation exchange membrane 1 arranged between the anode 200 and the cathode 300. Here, the electrolyzer 100 comprising the above-described the cation exchange membrane 1 is described as one example, but the electrolyzer in the present embodiment is not limited to this, and various modifications can be made to the configuration within the range of the effect of the present embodiment. Such an electrolyzer 100 can be used for various electrolyses, and as a typical example, a case where the electrolyzer 100 is used for electrolysis of an alkali chloride aqueous solution will be described below.

The electrolysis conditions are not particularly limited, and electrolysis can be performed under known conditions. For example, a 2.5 to 5.5 normal (N) alkali chloride aqueous solution is supplied to an anode chamber, water or a dilute alkali hydroxide aqueous solution is supplied to a cathode chamber, and electrolysis can be performed under the conditions of an electrolytic temperature of 50 to 120° C. and a current density of 5 to 100 A/dm$^2$.

The configuration of the electrolyzer 100 according to the present embodiment is not particularly limited, and, for example, the electrolyzer 100 may be unipolar or bipolar. The materials constituting the electrolyzer 100 are not particularly limited. For example, as the material of the anode chamber, titanium and the like resistant to alkali chlorides and chlorine are preferred, and as the material of the cathode chamber, nickel and the like resistant to alkali hydroxides and hydrogen are preferred. For arrangement of the electrodes, the cation exchange membrane 1 and the anode 200 may be arranged at an appropriate interval, but even if the anode 200 and the cation exchange membrane 1 are arranged in contact with each other, the electrolyzer 100 can be used without any problem. A cathode is generally arranged at an appropriate interval from a cation exchange membrane, but even a contact-type electrolyzer (zero-gap base electrolyzer) without this interval can be used without any problem.

By using the cation exchange membrane 1 in the present embodiment, operation can be stably performed. Conventionally, a decrease in current efficiency may occur when impurities such as $SiO_2$ are contained in an anolyte to be electrolyzed, but the decrease in current efficiency can be suppressed by using the cation exchange membrane 1 in the present embodiment.

EXAMPLES

The present embodiment will be described in detail below by Examples. The present embodiment is not limited to the following Examples. The following units are on a mass basis unless otherwise noted.

[Measurement Methods]

By subjecting a microscopic image of a surface of a cation exchange membrane to image analysis, the opening area ratio for opening portions and the exposed area ratio for exposed portions were measured. First, a surface of the membrane body of a cation exchange membrane after hydrolysis was cut to a size 2 mm long and 3 mm wide to provide a sample. The cut sample was immersed in a liquid obtained by dissolving 0.1 g of crystal violet, a dye, in a mixed solvent of 100 mL of water and 500 mL of ethanol, to dye the sample. The state of the surface of the sample after the dyeing was observed at a magnifying power of 20× using a microscope (manufactured by OLYMPUS). Nine samples were cut from a surface of one cation exchange membrane, and evaluation was performed with the average (N=9).

It was determined that a white region not dyed with the dye corresponded to an opening portion or an exposed portion. Which of an opening portion and an exposed portion a white region corresponded to was determined by the positional relationship between the reinforcement core materials and the continuous holes in the cation exchange membrane. When which of an opening portion and an exposed portion a white region corresponded to was unclear, it was determined from an SEM photograph when the area observed by the above microscope was observed by a scanning electron microscope (SEM). When a white region not dyed with the dye was depressed from the surface of the membrane body according to the SEM photograph, the white region was determined as an opening portion, and when a white region not dyed with the dye protruded from the surface of the membrane body according to the SEM photograph, the white region was determined as an exposed portion.

When a continuous hole or the like traverses an opening portion or an exposed portion, the part may be dyed with the dye, and a white region not dyed with the dye may be observed in a divided state. In this case, the white region not dyed with the dye was identified as the opening portion or the exposed portion being not divided by the continuous hole or the like and being continuous. When the cation exchange membrane had a coating layer, measurement was performed after only the coating was removed using a mixed solution of water and ethanol and using a soft brush.

[Opening Area Ratio for Opening Portions]

The opening area ratio for opening portions was obtained by first obtaining the total area of white portions corresponding to the opening portions of the above sample (opening portion area B), and dividing it by the surface area of the sample (2 mm×3 mm=6 $mm^2$). The opening area ratio was the average value of results obtained by observing in nine parts of the cation exchange membrane (N=9).

[Method for Measuring Exposed Area Ratio for Exposed Portions]

For the exposed area ratio for exposed portions, first, the total area of portions in which the reinforcement core materials were not present in the above sample was obtained, divided by the surface area of the sample (2 mm×3 mm=6 $mm^2$), and centupled to obtain the aperture ratio (unit: %). Next, the area of white portions corresponding to exposed portions (exposed portion area B) was obtained. The exposed area ratio for exposed portions was obtained by the following formula:

the exposed area ratio for exposed portions (%)=(the exposed portion area *B*/the surface area of the sample)/(1−the aperture ratio/100)×100 wherein "the surface area of the sample" represents the area of the membrane projected on a plane.

[Methods for Measuring Height and Arrangement Density of Raised Portions]

The height and arrangement density of raised portions were confirmed by the following methods. First, a point having the lowest height on a membrane surface of an area of a cation exchange membrane 1000 μm square was taken as a reference. Portions having a height of 20 μm or more from the reference point were taken as raised portions. At this time, as the method for measuring the height, measurement was performed using "Color 3D Laser Microscope (VK-9710)" manufactured by KEYENCE. Specifically, a 10 cm×10 cm part was arbitrarily cut from the cation exchange membrane in a dry state, a smooth plate and the cathode side of the cation exchange membrane were fixed by a double-sided tape, and the smooth plate and the cation exchange membrane were set on the measurement stage so that the anode side of the cation exchange membrane was directed toward the measurement lens. By observing the shape of the cation exchange membrane surface in a measurement area 1000 μm square on each 10 cm×10 cm membrane, taking a point having the lowest height as a reference, and measuring height therefrom, the raised portions were confirmed. The arrangement density of the raised portions was obtained by arbitrarily cutting 10 cm×10 cm membranes in three parts from the cation exchange membrane, measuring in nine parts in a measurement area 1000 μm square on each of the 10 cm×10 cm membranes, and averaging the measured values.

[Impurity Resistance Test]

When electrolysis was performed using an obtained cation exchange membrane, impurities were added to 5 N (normality) brine supplied as an electrolytic solution, and changes in the characteristics of the cation exchange membrane were measured. As the electrolyzer used for the electrolysis, one in which four electrolytic cells having a structure in which a cation exchange membrane was arranged between an anode and a cathode and being of a type in which an electrolytic solution was forcedly circulated (forced circulation-type) were arranged in series was used. The distance between the anode and the cathode in the electrolytic cell was 1.5 mm. As the cathode, an electrode in which nickel oxide as a catalyst was applied to an expanded metal of nickel was used. As the anode, an electrode in which ruthenium oxide, iridium oxide, and titanium oxide as catalysts were applied to an expanded metal of titanium was used.

Brine was supplied to the anode side so as to maintain a concentration of 205 g/L, and water was supplied to the cathode side while the caustic soda concentration was kept at 32% by mass. Brine containing 10 ppm of $SiO_2$ and 1 ppm of Al as impurities was used. With the temperature of the brine set at 90° C., electrolysis was performed for 7 days at a current density of 6 kA/$m^2$ under a condition in which the fluid pressure on the cathode side was 5.3 kPa higher than the fluid pressure on the anode side in the unit cell of the electrolyzer. Then, the increase or decrease in the value of current efficiency on the seventh day of the electrolysis from the value of current efficiency on the first day of the electrolysis was measured, and the change rate on a day-to-day basis was obtained. The current efficiency is the proportion of the amount of produced caustic soda to the passed current, and when impurity ions and hydroxide ions rather than sodium ions move through the cation exchange membrane due to the passed current, the current efficiency decreases. The current efficiency was obtained by dividing the amount by mole of caustic soda produced for a certain time by the amount by mole of the electrons of the current passing during that time. The number of moles of caustic soda was obtained by recovering caustic soda produced by the electrolysis in a plastic container and measuring its mass.

[Measurement of Common Salt Concentration in Caustic Soda]

Using the above electrolyzer, operation was performed under similar conditions except that electrolysis was performed using brine comprising substantially no impurities, and the concentration of common salt contained in the produced caustic soda was measured. In other words, brine was supplied to the anode side while being adjusted so as to reach a concentration of 205 g/L, and water was supplied while the caustic soda concentration on the cathode side was kept at 32% by mass. With the temperature of the brine set at 90° C., electrolysis was performed at a current density of 4 kA/$m^2$ under a condition in which the fluid pressure on the cathode side of the electrolyzer was 5.3 kPa higher than the fluid pressure on the anode side. The concentration of common salt contained in caustic soda obtained by performing the electrolysis for 7 days was measured in accordance with the method of JIS K 1200-3-1. In other words, nitric acid was added to caustic soda produced by the electrolysis for neutralization to form a neutralized solution, and an iron(III) ammonium sulfate solution and mercury(II) thiocyanate were added to the neutralized solution to color the solution. The caustic soda produced during the electrolysis operation overflowed the discharge pipes of the cells and flowed outside the cells, and therefore this was recovered. The common salt concentration in caustic soda was measured every other day by subjecting the solution to absorptiometric analysis by a UV meter, and the average value for 7 days was obtained as the common salt concentration in caustic soda.

[Measurement of Bending Resistance]

The degree of strength decrease due to bending of a cation exchange membrane (bending resistance) was evaluated by the following method. The bending resistance is the proportion of the tensile elongation of a cation exchange membrane after bending to the tensile elongation of the cation exchange membrane before bending (tensile elongation proportion).

The tensile elongation was measured by the following method. A sample having a width of 1 cm was cut along a direction at 45 degrees to reinforcement yarns embedded in a cation exchange membrane. Then, the tensile elongation of the sample was measured under the conditions of a chuck-to-chuck distance of 50 mm and a tensile speed of 100 mm/min in accordance with JISK6732.

[Measurement of Carboxylic Acid Layer Damage Rate]

The carboxylic acid layer damage rate was measured by taking a photograph of the cation exchange membrane after the above impurity resistance test seen in top view from the cathode surface side and dividing the area of portions in which the carboxylic acid layer was damaged and whitened by the entire area.

Example 1

As reinforcement core materials, 90 denier monofilaments made of polytetrafluoroethylene (PTFE) were used (hereinafter referred to as PTFE yarns). As sacrifice yarns, yarns obtained by twisting six 35 denier filaments of polyethylene terephthalate (PET) 200 times/m were used (hereinafter referred to as PET yarns). First, the PTFE yarns and the sacrifice yarns were plain-woven with 24 PTFE yarns/inch so that two sacrifice yarns were arranged between adjacent PTFE yarns, to obtain a woven fabric (see FIG. 12). The obtained woven fabric was pressure-bonded by a roll to provide a strengthening material having a thickness of 70 μm.

Next, a polymer A of a dry resin that was a copolymer of $CF_2{=}CF_2$ and $CF_2{=}CFOCF_2CF(CF_3)OCF_2CF_2COOCH_3$ and had an ion exchange capacity of 0.85 mg equivalent/g, and a polymer B of a dry resin that was a copolymer of $CF_2{=}CF_2$ and $CF_2{=}CFOCF_2CF(CF_3)OCF_2CF_2SO_2F$ and had an ion exchange capacity of 1.01 mg equivalent/g were prepared.

Using these polymers A and B, a two-layer film X in which the thickness of a polymer A layer was 25 μm and the thickness of a polymer B layer was 74 μm was obtained by a coextrusion T die method. A single-layer film Y of only the polymer B having a thickness of 20 μm was obtained by a T die method.

Then, release paper (embossed in a conical shape having a height of 50 μm), the film Y, the strengthening material, and the film X (so that the film constituting the sulfonic acid layer was on the strengthening material side) were laminated in this order on a drum having a heat source and a vacuum source inside and having micropores on its surface, and heated and depressurized under the conditions of a drum temperature of 223° C. and a degree of reduced pressure of 0.067 MPa for 2 minutes, and then the release paper was removed to obtain a composite membrane. The obtained composite membrane was immersed in an aqueous solution at 85° C. comprising 30% by mass of dimethyl sulfoxide (DMSO) and 15% by mass of potassium hydroxide (KOH) for 1 hour for saponification. Then, the composite membrane was immersed in an aqueous solution at 50° C. comprising 0.5 N sodium hydroxide (NaOH) for 1 hour to replace the counterion of the ion exchange group by Na, and then water-washed. Then, with the running tension, the relative speed between a polishing roll and the membrane, and the amount of pressing of the polishing roll set at 20 kg/cm, 100 m/min, and 2 mm respectively, a membrane surface was polished to form opening portions. The amount of pressing refers to the difference between the position where the polishing roll comes into contact with the membrane and the position where the polishing roll actually polishes the membrane. As the amount of pressing increases, the holding angle of the polishing roll increases, and therefore many opening portions are formed.

Further, 20% by mass of zirconium oxide having a primary particle size of 1 μm was added to a 5% by mass ethanol solution of the acid-type polymer of the polymer B and dispersed to prepare a suspension, and the suspension was sprayed onto both surfaces of the above composite membrane by a suspension spray method to form 0.5 $mg/cm^2$ coatings of zirconium oxide on the surfaces of the composite membrane to obtain a cation exchange membrane.

In the cation exchange membrane obtained as described above, the opening area ratio for opening portions was 0.5%, and the exposed area ratio for exposed portions was 0%. It was confirmed that the arrangement density of raised portions having a height of 20 μm or more was 20 to $1500/cm^2$. As a result of performing an electrolytic experiment using this cation exchange membrane, the chloride ion concentration in caustic soda was as low as 10 ppm. The carboxylic acid layer damage rate after the electrolytic experiment was 16%, showing resistance to carboxylic acid layer damage. The bending resistance was 60%, showing sufficient strength.

Example 2

A cation exchange membrane was made as in Example 1 except that the tension during polishing was 30 kg/cm, and the amount of pressing of the polishing roll was 5 mm. In the cation exchange membrane obtained as described above, the opening area ratio for opening portions was 5.0%, and the exposed area ratio for exposed portions was 0.5%. It was confirmed that the arrangement density of raised portions having a height of 20 μm or more was 20 to $1500/cm^2$. As a result of performing an electrolytic experiment as in Example 1, the common salt concentration in caustic soda was as low as 12 ppm. The carboxylic acid layer damage rate after the electrolytic experiment was 14%, showing resistance to carboxylic acid layer damage. The bending resistance was 55%, showing sufficient strength.

Example 3

A cation exchange membrane was made as in Example 1 except that the tension during polishing was 40 kg/cm, and the amount of pressing of the polishing roll was 7 mm. In the cation exchange membrane obtained as described above, the opening area ratio for opening portions was 14.8%, and the exposed area ratio for exposed portions was 2.1%. It was confirmed that the arrangement density of raised portions having a height of 20 μm or more was 20 to $1500/cm^2$. As a result of performing an electrolytic experiment as in Example 1, the common salt concentration in caustic soda was as low as 15 ppm. The carboxylic acid layer damage rate after the electrolytic experiment was 12%, showing resistance to carboxylic acid layer damage. The bending resistance was 40%, showing sufficient strength.

Comparative Example 1

A cation exchange membrane was made as in Example 1 except that the polishing step was omitted. In the cation exchange membrane obtained as described above, the opening area ratio for opening portions was 0%, and the exposed area ratio for exposed portions was 0%. It was confirmed that the arrangement density of raised portions having a height of 20 μm or more was 20 to 1500/cm$^2$. As a result of performing an electrolytic experiment as in Example 1, the common salt concentration in caustic soda was as low as 10 ppm, but the carboxylic acid layer damage rate after the electrolytic experiment was 24%, not showing resistance to carboxylic acid layer damage.

Comparative Example 2

A cation exchange membrane was made as in Example 1 except that the tension during polishing was 40 kg/cm, and the amount of pressing of the polishing roll was 10 mm. In the cation exchange membrane obtained as described above, the opening area ratio for opening portions was 18%, and the exposed area ratio for exposed portions was 4.8%. It was confirmed that the arrangement density of raised portions having a height of 20 μm or more was 20 to 1500/cm$^2$. As a result of performing an electrolytic experiment as in Example 1, the common salt concentration in caustic soda was as low as 20 ppm. The carboxylic acid layer damage rate after the electrolytic experiment was 11%, showing resistance to carboxylic acid layer damage. However, the bending resistance was 20%, not showing resistance to bending.

Example 4

A cation exchange membrane was made as in Example 1 except that as the reinforcement core materials, those obtained by twisting 100 denier tape yarns made of polytetrafluoroethylene (PTFE) 900 times/m into a thread form were used, the tension during polishing was 30 kg/cm, and the amount of pressing of the polishing roll was 5 mm. In the cation exchange membrane obtained as described above, the opening area ratio for opening portions was 1%, and the exposed area ratio for exposed portions was 1%. It was confirmed that the arrangement density of raised portions having a height of 20 μm or more was 20 to 1500/cm$^2$. As a result of performing an electrolytic experiment as in Example 1, the common salt concentration in caustic soda was as low as 11 ppm. The carboxylic acid layer damage rate after the electrolytic experiment was 15%, showing resistance to carboxylic acid layer damage. The bending resistance was 55%, showing sufficient strength.

Example 5

A cation exchange membrane was made as in Example 4 except that the tension during polishing was 40 kg/cm, and the amount of pressing of the polishing roll was 7 mm. In the cation exchange membrane obtained as described above, the opening area ratio for opening portions was 2.8%, and the exposed area ratio for exposed portions was 2.8%. It was confirmed that the arrangement density of raised portions having a height of 20 μm or more was 20 to 1500/cm$^2$. As a result of performing an electrolytic experiment as in Example 1, the common salt concentration in caustic soda was as low as 13 ppm. The carboxylic acid layer damage rate after the electrolytic experiment was 12%, showing resistance to carboxylic acid layer damage. The bending resistance was 45%, showing sufficient strength.

Example 6

A cation exchange membrane was made as in Example 4 except that the tension during polishing was 40 kg/cm, and the amount of pressing of the polishing roll was 7 mm. In the cation exchange membrane obtained as described above, the opening area ratio for opening portions was 5.2%, and the exposed area ratio for exposed portions was 5.2%. It was confirmed that the arrangement density of raised portions having a height of 20 μm or more was 20 to 1500/cm$^2$. As a result of performing an electrolytic experiment as in Example 1, the common salt concentration in caustic soda was as high as 40 ppm. The carboxylic acid layer damage rate after the electrolytic experiment was 1%, showing resistance to carboxylic acid layer damage. The bending resistance was 40%, showing sufficient strength.

Comparative Example 3

A cation exchange membrane was made as in Example 1 except that the polishing step was carried out before the saponification step, the tension during polishing was 30 kg/cm, and the amount of pressing of the polishing roll was 5 mm. In the cation exchange membrane obtained as described above, the opening area ratio for opening portions was 5%, and the exposed area ratio for exposed portions was 5.5%. When observation was performed by an electron microscope, it was found that the raised portion shape was scraped and disappeared. As a result of performing an electrolytic experiment as in Example 1, the common salt concentration in caustic soda was as high as 55 ppm, and the carboxylic acid layer damage rate after the electrolytic experiment was 26%, very poor.

The results of Examples 1 to 5 and Comparative Examples 1 to 3 are shown in Table 1.

TABLE 1

| | | Example 1 | Example 2 | Example 3 | Example 4 | Example 5 |
|---|---|---|---|---|---|---|
| Membrane configuration | First layer as produced (μm) | 99 | 99 | 99 | 99 | 99 |
| | S layer thickness (μm) | 25 | 25 | 25 | 25 | 25 |
| | C layer thickness (μm) | 74 | 74 | 74 | 74 | 74 |
| | Second layer as produced (μm) | 20 | 20 | 20 | 20 | 20 |
| | Core materials | Round yarns | Round yarns | Round yarns | Tape yarns | Tape yarns |

TABLE 1-continued

| | | | | | | |
|---|---|---|---|---|---|---|
| Embedding conditions | Temperature | 223° C. | 223° C. | 223° C. | 223° C. | 223° C. |
| | Time | 2 min | 2 min | 2 min | 2 min | 2 min |
| | Reduced pressure | 0.067 MPa | 0.067 MPa | 0.067 MPa | 0.067 MPa | 0.067 MPa |
| Polishing conditions | Running tension | 20 kg/cm | 30 kg/cm | 40 kg/cm | 30 kg/cm | 40 kg/cm |
| | Amount of pressing | 2 mm | 5 mm | 7 mm | 5 mm | 7 mm |
| | Polishing roll speed | 100 m/min | 100 m/min | 100 m/min | 100 m/min | 100 m/min |
| Membrane shape | Raised structures | Present | Present | Present | Present | Present |
| Area ratios | Opening area ratio (%) | 0.5 | 5 | 14.8 | 1 | 2.8 |
| | Exposed area ratio (%) | 0 | 0.5 | 2.1 | 1 | 2.8 |
| Electrolytic characteristics | Salt in caustic soda (ppm) | 10 | 12 | 15 | 11 | 13 |
| | Bending test (%) | 60 | 55 | 40 | 55 | 45 |
| | C damage (%) | 16 | 14 | 12 | 15 | 12 |
| | Current efficiency decrease in impurity test (%) | 0.1 | 0.07 | 0.06 | 0.07 | 0.07 |

| | | Example 6 | Comparative Example 1 | Comparative Example 2 | Comparative Example 3 |
|---|---|---|---|---|---|
| Membrane configuration | First layer as produced (μm) | 99 | 99 | 99 | 99 |
| | S layer thickness (μm) | 25 | 25 | 25 | 25 |
| | C layer thickness (μm) | 74 | 74 | 74 | 74 |
| | Second layer as produced (μm) | 20 | 20 | 20 | 20 |
| | Core materials | Tape yarns | Round yarns | Round yarns | Round yarns |
| Embedding conditions | Temperature | 223° C. | | 223° C. | 223° C. |
| | Time | 2 min | | 2 min | 2 min |
| | Reduced pressure | 0.067 MPa | | 0.067 MPa | 0.067 MPa |
| Polishing conditions | Running tension | 40 kg/cm | | 40 kg/min | 30 kg/cm |
| | Amount of pressing | 10 mm | | 10 mm | 5 mm |
| | Polishing roll speed | 100 m/min | | 100 m/min | 100 m/min |
| Membrane shape | Raised structures | Present | Present | Present | Absent |
| Area ratios | Opening area ratio (%) | 5.2 | 0 | 18 | 5 |
| | Exposed area ratio (%) | 5.2 | 0 | 4.8 | 5.5 |
| Electrolytic characteristics | Salt in caustic soda (ppm) | 50 | 10 | 20 | 55 |
| | Bending test (%) | 40 | 60 | 20 | 60 |
| | C damage (%) | 11 | 24 | 11 | 26 |
| | Current efficiency decrease in impurity test (%) | 0.07 | 0.3 | 0.08 | 0.25 |

As shown in Table 1, it was confirmed that the cation exchange membranes of Examples 1 to 5 had sufficient mechanical strength, and at the same time the amount of the alkali hydroxide in the obtained alkali chloride was small, the cathode surface damage was little, and stable electrolytic characteristics were exhibited.

INDUSTRIAL APPLICABILITY

The cation exchange membrane of the present invention can be preferably used as a cation exchange membrane for alkali chloride electrolysis or the like.

DESCRIPTION OF SYMBOLS

1, 2, 3, 4 . . . cation exchange membrane
5 . . . strengthening material
10, 20, 30, 40 . . . membrane body
11, 21, 31, 41 . . . raised portion
12, 22, 32, 42, 52 . . . reinforcement core material
10*a*, 20*a*, 30*a*, 40*a* . . . first layer (sulfonic acid layer)
10*b*, 20*b*, 30*b*, 40*b* . . . second layer (carboxylic acid layer)
34*a*, 34*b*, 44*a*, 44*b* . . . coating layer
100 . . . electrolyzer
102, 202, 302, 402 . . . opening portion
104, 204, 304, 404, 504 . . . continuous hole
106 . . . hole
200 . . . anode
300 . . . cathode
504*a* . . . sacrifice yarn
A1, A2, A3, A4 . . . region
A5 . . . exposed portion

The invention claimed is:

1. A cation exchange membrane comprising:

a membrane body comprising a fluorine-containing polymer having an ion exchange group, and continuous holes formed inside of the membrane body; and a reinforcement core material arranged inside the membrane body, the reinforcement core material having a first layer side and a second layer side that opposes the first layer side, wherein the continuous holes are formed so as to alternately pass on the first layer side and the second layer side, wherein raised portions having a height of 20 μm or more in cross-sectional view are formed on at least one surface of the membrane body, an arrangement density of the raised portions on the surface of the membrane body is 20 to 1500/cm$^2$, a plurality of opening portions are formed on the surface of the membrane body, and wherein the continuous holes allow at least two of the plurality of opening portions to communicate with each other, and an opening area ratio, which is a proportion of a total area of the opening portions to an area of the surface of the membrane body, is in a range of 1 to 15%.

2. The cation exchange membrane according to claim 1, wherein an opening density of the opening portions on the surface of the membrane body is 10 to 1000/cm$^2$.

3. The cation exchange membrane according to claim 1, wherein an exposed area ratio calculated by the following formula is 5% or less:

the exposed area ratio (%)=(a sum of projected areas of exposed portions in which a part of the reinforcement core material is exposed, provided that the surface of the membrane body is seen in top view)/(a projected area of the surface of the membrane body)×100.

4. The cation exchange membrane according to claim 1, wherein the reinforcement core material comprises a fluorine-containing polymer.

5. The cation exchange membrane according to claim 1, wherein the membrane body has a first layer comprising a fluorine-containing polymer having a sulfonic acid group, and a second layer comprising a fluorine-containing polymer having a carboxylic acid group laminated on the first layer, and the opening portions are formed on a surface of the first layer.

6. The cation exchange membrane according to claim 1, further comprising a coating layer coating at least a part of at least one surface of the membrane body.

7. The cation exchange membrane according to claim 1, wherein the raised portions have at least one shape selected from a group consisting of a conical shape, a polygonal pyramid shape, a truncated cone shape, a truncated polygonal pyramid shape, and a hemispherical shape.

8. An electrolyzer comprising:

an anode;

a cathode; and the cation exchange membrane according to claim 1 arranged between the anode and the cathode.

* * * * *